US010102960B2

(12) United States Patent
Yosui

(10) Patent No.: US 10,102,960 B2
(45) Date of Patent: Oct. 16, 2018

(54) ELECTRONIC COMPONENT

(71) Applicant: Murata Manufacturing Co., Ltd., Nagaokakyo-shi, Kyoto-fu (JP)

(72) Inventor: Kuniaki Yosui, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 284 days.

(21) Appl. No.: 14/928,297

(22) Filed: Oct. 30, 2015

(65) Prior Publication Data

US 2016/0049237 A1 Feb. 18, 2016

Related U.S. Application Data

(63) Continuation of application No. PCT/JP2014/067374, filed on Jun. 30, 2014.

(30) Foreign Application Priority Data

Jul. 11, 2013 (JP) ..... 2013-145519

(51) Int. Cl.
*H01F 5/00* (2006.01)
*H01F 27/28* (2006.01)
*H01F 17/00* (2006.01)

(52) U.S. Cl.
CPC ..... *H01F 27/2804* (2013.01); *H01F 17/0013* (2013.01); *H01F 2017/0093* (2013.01); *H01F 2027/2809* (2013.01)

(58) Field of Classification Search
USPC ..... 336/200, 232
See application file for complete search history.

(56) References Cited

U.S. PATENT DOCUMENTS 6,445,593 B1 * 9/2002 Okuyama ..... H01F 17/0013 257/421
2002/0030576 A1 * 3/2002 Kusano ..... H01F 17/0006 336/223

(Continued)

FOREIGN PATENT DOCUMENTS

JP 5-36532 A 2/1993
JP 2001-196227 A 7/2001

(Continued)

OTHER PUBLICATIONS

Official Communication issued in International Patent Application No. PCT/JP2014/067374, dated Sep. 22, 2014.

*Primary Examiner* — Elvin G Enad
*Assistant Examiner* — Kazi Hossain
(74) *Attorney, Agent, or Firm* — Keating & Bennett, LLP

(57) ABSTRACT

An electronic component includes a multilayer body including insulating layers stacked in a stacking direction, first and second linear conductors having different line widths and provided on a respective one of the insulating layers, and third and fourth linear conductors having different line widths and provided on a respective one of the insulating layers. The insulating layer(s) supporting the third and fourth linear conductors is/are at one side in the stacking direction of the insulating layer(s) supporting the first and the second linear conductors. In a planar view from the stacking direction, the first and the fourth linear conductors overlap each other, and the second and the third linear conductors overlap each other. The first, the second, the third and the fourth linear conductors are electrically connected to define a coil.

10 Claims, 19 Drawing Sheets

(56) References Cited

U.S. PATENT DOCUMENTS

| | | | | |
|---|---|---|---|---|
| 2006/0214759 | A1* | 9/2006 | Kawarai | H01F 17/0006 336/200 |
| 2008/0042785 | A1 | 2/2008 | Yagisawa | |
| 2008/0257488 | A1* | 10/2008 | Yamano | H01F 17/0013 156/272.4 |
| 2008/0303622 | A1 | 12/2008 | Park et al. | |
| 2010/0295646 | A1 | 11/2010 | Harrison et al. | |
| 2011/0074535 | A1 | 3/2011 | Banno | |
| 2011/0163832 | A1* | 7/2011 | Ueno | H01F 17/0013 336/200 |
| 2011/0248811 | A1* | 10/2011 | Kireev | H01L 23/5227 336/200 |

FOREIGN PATENT DOCUMENTS

| | | | |
|---|---|---|---|
| JP | 2003-59722 | A | 2/2003 |
| JP | 2008-47711 | A | 2/2008 |
| JP | 2008-306185 | A | 12/2008 |
| JP | 2011-77157 | A | 4/2011 |
| JP | 2012-510725 | A | 5/2012 |

* cited by examiner

ELECTRONIC COMPONENT

BACKGROUND OF THE INVENTION

1. Field of the Invention

The present invention relates to an electronic component, and more particularly to an electronic component including a coil.

2. Description of the Related Art

As an example of conventional electronic devices, a high-frequency coil as disclosed in Japanese Patent Laid-Open Publication No. H05-36532 is well known. FIG. 16 is an exploded perspective view of the high-frequency coil 500.

As indicated in FIG. 16, the high-frequency coil 500 includes dielectric layers 502*a* and 502*b*, and coil patterns 504*a* and 504*b*. The coil patterns 504*a* and 504*b* are linear conductors turning clockwise on the dielectric layers 502*a* and 502*b*, respectively. The coil patterns 504*a* and 504*b* are connected to each other through a via-hole, thereby forming a coil.

In the high-frequency coil 500, the line width d1 of the coil pattern 504*a* is smaller than the line width d2 of the coil pattern 504*b*. When viewed from a layer stacking direction, the coil pattern 504*a* overlaps the coil pattern 504*b* so as not to protrude from the coil pattern 504*b*. Thereby, even if an error occurs in a step of stacking the dielectric layers 502*a* and 502*b* during a production process of the high-frequency coil 500, the square measure of the overlap area of the coil patterns 504*a* and 504*b* is unlikely to change. Accordingly, the floating capacitance between the coil patterns 504*a* and 504*b* is unlikely to change.

In the meantime, in order to obtain a large inductance value from the high-frequency coil 500, for example, each of the coil patterns 504*a* and 504*b* may be a spiral coil pattern. This, however, causes a problem that the size of the high-frequency coil 500 is increased. FIG. 17 is a sectional view of the high-frequency coil 500 in which spiral coil patterns 504*a* and 504*b* are used.

In the high-frequency coil 500 illustrated in FIG. 17, portions of the coil pattern 504*a* extending side by side with each other need to be at a certain distance from each other so as to prevent a short circuit. Likewise, portions of the coil patterns 504*b* extending side by side with each other need to be at a certain distance from each other so as to prevent a short circuit. Also, in order to arrange the coil pattern 504*a* to overlap the coil pattern 504*b* without protruding from the coil pattern 504*b* when viewed from the layer stacking direction, the distance d11 between the respective centers of the portions of the coil pattern 504*a* extending side by side with each other is equal or substantially equal to the distance d12 between the respective centers of the portions of the coil pattern 504*b* extending side by side with each other. Accordingly, the gap between the portions of the coil pattern 504*a* extending side by side with each other is greater than the gap between the portions of the coil pattern 504*b* extending side by side with each other, and therefore, in the high-frequency coil 500 illustrated in FIG. 17, the distance between the portions of the coil pattern 504*a* extending side by side with each other is greater than necessary. With regard to the high-frequency coil 500 illustrated in FIG. 17, as described above, it is necessary to design the high-frequency coil 500 based on the coil pattern 504*b* having a greater width of d2. This results in a problem that the dimensions of the high-frequency coil 500 in directions perpendicular to the layer stacking direction are increased.

SUMMARY OF THE INVENTION

Preferred embodiments of the present invention provide an electronic component including a coil, which has a greatly reduced size.

An electronic component according to a first preferred embodiment includes a multilayer body including a plurality of insulating layers stacked on one another in a stacking direction; a first linear conductor provided on one of the insulating layers and having a first line width; a second linear conductor provided on one of the insulating layers and having a second line width smaller than the first line width; a third linear conductor provided on one of the insulating layers that is arranged at one side in the stacking direction of the insulating layer on which the first linear conductor is provided and the insulating layer on which the second linear conductor are provided, and having a third line width; and a fourth linear conductor provided on one of the insulating layers that is arranged at one side in the stacking direction of the insulating layer on which the first linear conductor is provided and the insulating layer on which the second linear conductor are provided, and having a fourth line width smaller than the third line width, wherein the first linear conductor and the second linear conductor are arranged in a widthwise direction of the first and the second linear conductors; the third linear conductor and the fourth linear conductor are arranged in a widthwise direction of the third and the fourth linear conductors; the first linear conductor and the fourth linear conductor overlap each other in a planar view from the stacking direction; the second linear conductor and the third linear conductor overlap each other in a planar view of the stacking direction; and the first, the second, the third and the fourth linear conductors are electrically connected to define a coil.

An electronic component according to a second preferred embodiment includes a multilayer body including a plurality of insulating layers, stacked on one another in a stacking direction; a first linear conductor provided on one of the insulating layers and having a first line width; a second linear conductor provided on one of the first insulating layers and having a second line width smaller than the first line width; a third linear conductor provided on one of the insulating layers that is arranged at one side in the stacking direction of the insulating layer on which the first linear conductor is provided and the insulating layer on which the second linear conductor are provided, and having a third line width; and a fourth linear conductor provided on one of the insulating layers that is arranged at one side in the stacking direction of the insulating layer on which the first linear conductor is provided and the insulating layer on which the second linear conductor are provided, and having a fourth line width smaller than the third line width, wherein the first linear conductor and the second linear conductor are arranged in a widthwise direction of the first and the second linear conductors; the third linear conductor and the fourth linear conductor are arranged in a widthwise direction of the third and the fourth linear conductors; the first linear conductor and the fourth linear conductor overlap each other in a planar view from the stacking direction; the second linear conductor and the third linear conductor overlap each other in a planar view of the stacking direction; the first linear conductor and the second linear conductor are electrically connected to define a first coil; and the third linear conductor and the fourth linear conductor are electrically connected to define a second coil, to define a common-mode choke coil in conjunction with the first coil.

Preferred embodiments of the present invention achieve downsizing of an electronic component.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
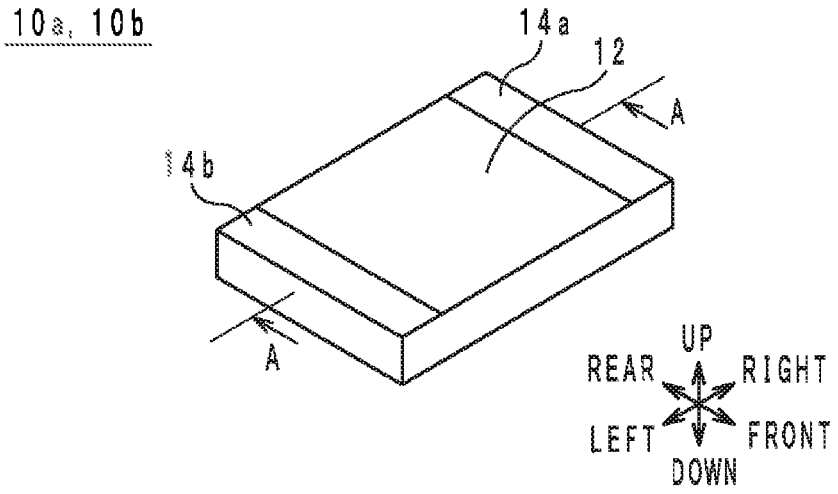
FIG. 1 is a perspective view of an electronic component according to a first preferred embodiment of the present invention.
Figure 2:
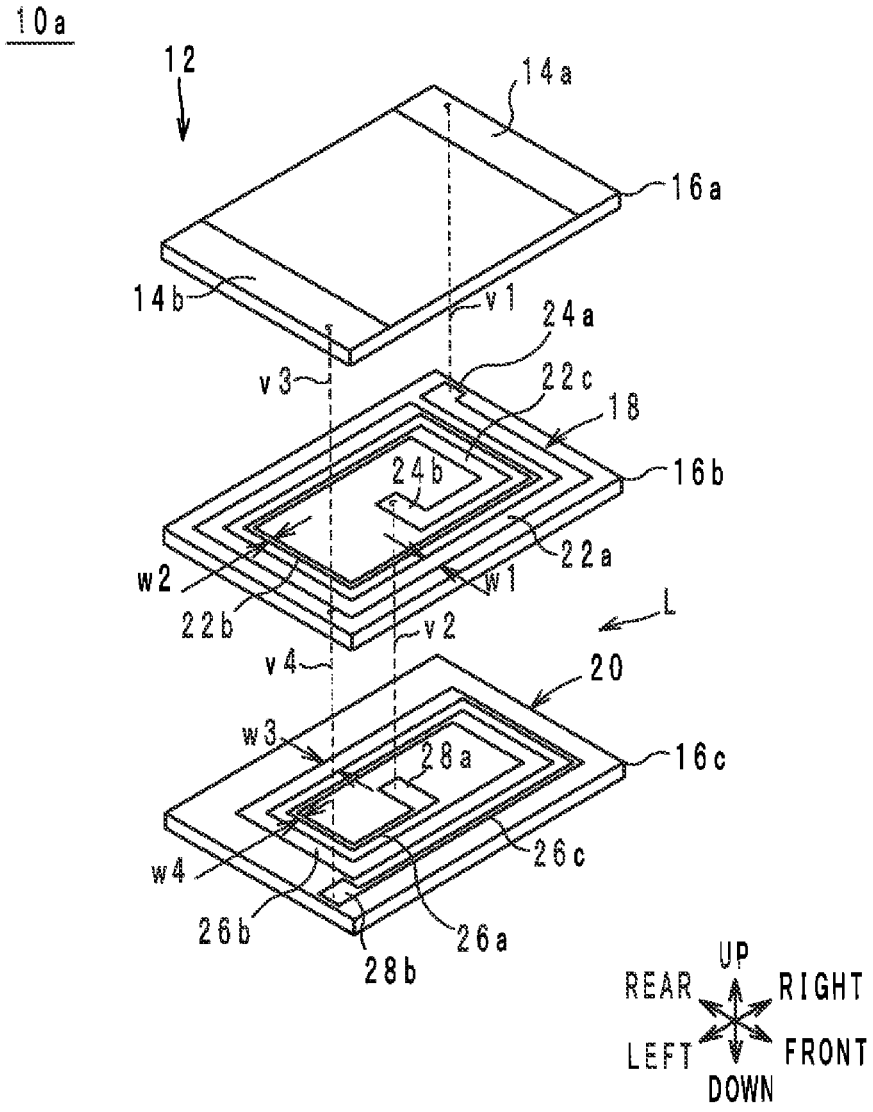
FIG. 2 is an exploded perspective view of the electronic component according to the first preferred embodiment of the present invention.
Figure 3A:
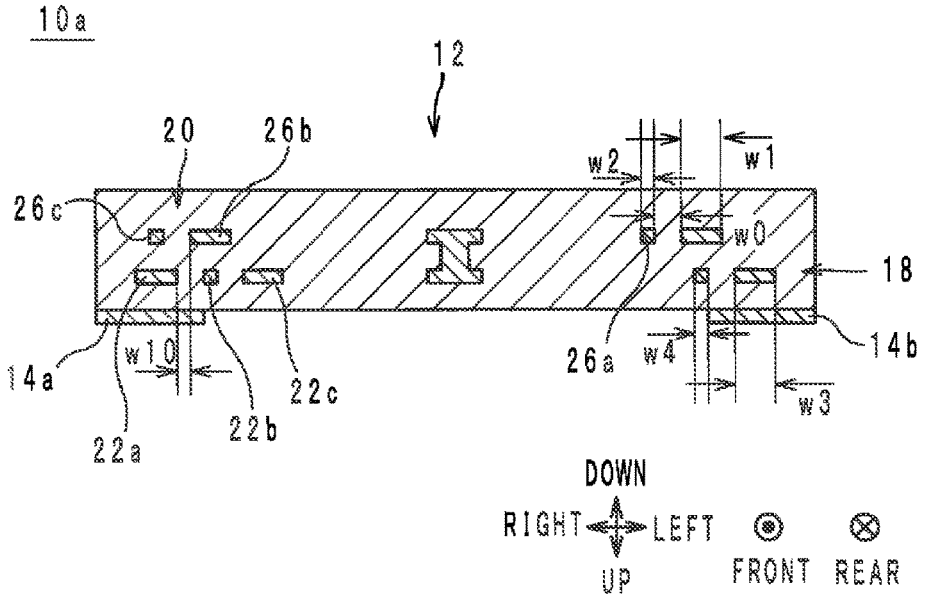
FIG. 3A is a sectional view of the electronic component cut along the line A-A.
Figure 3B:
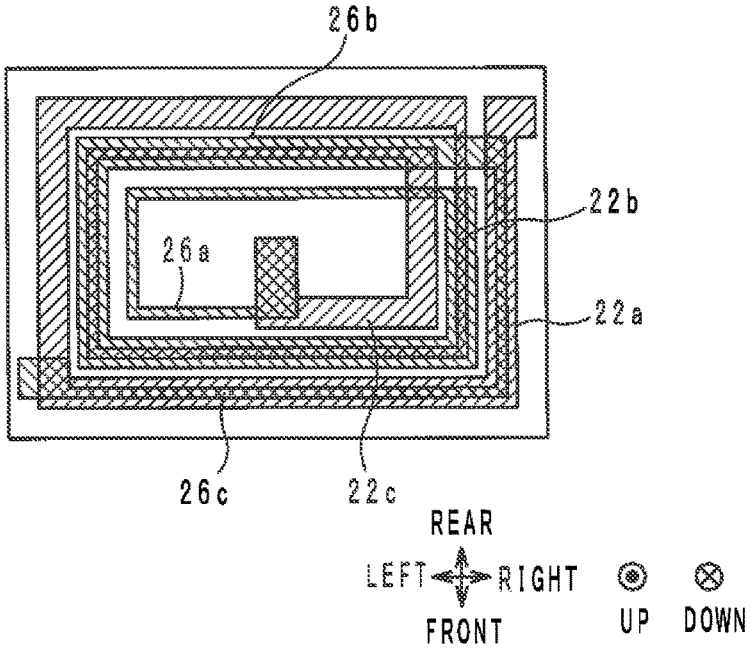
FIG. 3B is a plan view of coil conductors of the electronic component.

An electronic component according to a first preferred embodiment of the present invention will hereinafter be described with reference to the drawings. FIG. 1 is a perspective view of the electronic component 10*a* according to the first preferred embodiment. FIG. 2 is an exploded perspective view of the electronic component 10*a* according to the first preferred embodiment. FIG. 3A is a sectional view of the electronic component 10*a* cut along the line A-A. FIG. 3B is a plan view of coil conductors 18 and 20 of the electronic component 10*a*. In the following description, the layer stacking direction of the electronic component 10*a* is referred to as an up-down direction. In a top-down planar view, the direction in which longer sides of the electronic component 10*a* extend is referred to as a right-left direction, and the direction in which shorter sides of the electronic component 10*a* extend is referred to as a front-rear direction.

The electronic component 10*a* includes a multilayer body 12, external electrodes 14*a* and 14*b*, and a coil L. As seen in FIGS. 1 and 2, the multilayer body 12 preferably is a rectangular or substantially rectangular plate in a top-down planar view. The multilayer body 12 includes dielectric (insulating) layers 16*a*-16*c* stacked in this order from the top to the bottom. The dielectric layers 16*a*-16*c* preferably are rectangular or substantially rectangular and are made of a flexible dielectric material, for example, liquid crystal polymer. The dielectric layers 16*a*-16*c* are flexible, and accordingly, the multilayer body 12 is flexible. In the following description, the upper surface of each of the dielectric layers 16*a*-16*c* is referred to as a front surface, and the lower surface of each of the dielectric layers 16*a*-16*c* is referred to as a back surface.

The external electrodes 14*a* and 14*b* are provided on the front surface of the dielectric layer 16*a*, and each of the external electrodes 14*a* and 14*b* preferably has a rectangular or substantially rectangular shape that is long in the front-rear direction. The external electrode 14*a* extends along a right shorter side of the dielectric layer 16*a*. The external electrode 14*b* extends along a left shorter side of the dielectric layer 16*a*. The external electrodes 14*a* and 14*b* are formed, for example, by plating a copper foil with Ni and Sn.

The coil L includes coil conductors 18 and 20, and via-hole conductors v1-v4. The coil conductor 18 is provided on the front surface of the dielectric layer 16*b* and is made of a copper foil, for example. The coil conductor 18 includes linear conductive portions 22*a*-22*c* and connection conductive portions 24*a* and 24*b*. In a top-down planar view, the coil conductor 18 has a spiral shape spiraling clockwise from the outer circumference toward the center. In the following description, the upstream edge of the clockwise spiral of the coil conductor 18 or each of the linear conductive portions 22*a*-22*c* is referred to as an upstream edge, and the downstream edge of the clockwise spiral of the coil conductor 18 or each of the linear conductive portions 22*a*-22*c* is referred to as a downstream edge.

The linear conductive portion 22*a* has a length corresponding to substantially one turn and a line width of w1. The length corresponding to one turn means one turn of the spiral coil conductor 18. Specifically, the linear conductive portion 22*a* extends along the right shorter side, the front longer side, the left shorter side and the rear longer side of the dielectric layer 16*b*. The upstream edge and the downstream edge of the linear conductive portion 22*a* are located near the right rear corner of the dielectric layer 16*b*. However, the upstream edge of the linear conductive portion 22*a* and the downstream edge of the linear conductive portion 22*a* are separate from each other.

The linear conductive portion 22*b* has a length corresponding to substantially one turn and a line width of w2. The width w2 is smaller than the width w1. Specifically, the linear conductive portion 22*b* is arranged at the inner side of the linear conductive portion 22*a* to define an inner portion of the spiral coil conductor 18 than the linear conductive portion 22*a*. The linear conductive portion 22*b* extends along the right shorter side, the front longer side, the left shorter side and the rear longer side of the dielectric layer 16*b*. Accordingly, the linear conductive portion 22*b* extends parallel or substantially parallel to the linear conductive portion 22*a* keeping a constant or substantially constant gap of w0 (see FIG. 3A) with the linear conductive portion 22*a*. The upstream edge and the downstream edge of the linear conductive portion 22*b* are located near the right rear corner of the dielectric layer 16*b*. However, the upstream edge of the linear conductive portion 22*b* and the downstream edge of the linear conductive portion 22*b* are separate from each other. The upstream edge of the linear conductive portion 22*b* is connected to the downstream edge of the linear conductive portion 22*a*.

The linear conductive portion 22*c* has a length smaller than one turn and a line width of w1. Specifically, the linear conductive portion 22*c* is arranged at the inner side of the linear conductive portion 22*b* to define an inner portion of the spiral coil conductor 18 than the linear conductive portion 22*b*. The linear conductive portion 22*c* extends along the right shorter side and the right half of the front longer side of the dielectric layer 16*b*. Accordingly, the linear conductive portion 22*c* extends parallel or substantially parallel to the linear conductive portion 22*b* keeping a constant or substantially constant gap of w0 (see FIG. 3A) with the linear conductive portion 22*b*. The upstream edge of the linear conductive portion 22*c* is located near the right rear corner of the dielectric layer 16*b*. The downstream edge of the linear conductive portion 22*c* is located near the center (the intersection point of the diagonal lines) of the dielectric layer 16*b*. The upstream edge of the linear conductive portion 22*c* is connected to the downstream edge of the linear conductive portion 22*b*.

As described above, the linear conductive portion 22*a* having a line width of w1, the linear conductive portion 22*b* having a line width of w2 and the linear conductive portion 22*c* having a line width of w1 are connected in this order (that is, linear conductive portions having line widths of w1 and linear conductive portions having line widths of w2 are connected alternately) to define the coil conductor 18 in a spiral shape. The length of the linear conductive portion 22*c* is smaller than the length of the linear conductive portion 22*b*. Therefore, almost the entire length of the linear conductive portion 22*c* extends along the linear conductive portion 22*b*. The length of the linear conductive portion 22*a* is equal or substantially equal to the length of the linear conductive portion 22*b* (corresponding to about one turn). Therefore, almost the entire length of the linear conductive portion 22*b* extends along the linear conductive portion 22*a*. Accordingly, in the coil conductor 18, the linear conductive portion 22*a* having a line width of w1, the linear conductive portion 22*b* having a line width of w2 and the linear conductive portion 22*c* having a line width of w1 are arranged in this order (that is, linear conductive portions having line widths of w1 and linear conductive portions having line widths of w2 are arranged alternately) from the outer circumference toward the center. As illustrated in FIG. 3A, in the coil conductor 18, the linear conductive portion 22*a* having a line width of w1, the linear conductive portion 22*b* having a line width of w2 and the linear conductive portion 22*c* having a line width of w1 are arranged in this order (that is, linear conductive portions having line widths of w1 and linear conductive portions having line widths of w2 are arranged alternately) in a widthwise direction with uniform or substantially uniform gaps of w0 therebetween. The widthwise direction is a direction perpendicular or substantially perpendicular to the extending direction of the linear conductive portions 22*a*-22*c*. In FIG. 3A, the widthwise direction is the right-left direction, for example.

The connection conductive portion 24*a* is connected to the upstream edge of the linear conductive portion 22*a* and is arranged at the rear right corner of the dielectric layer 16*b*. The connection conductive portion 24*b* is connected to the downstream edge of the linear conductive portion 22*c* and is arranged in the center (on the intersection point of the diagonal lines) of the dielectric layer 16*b*.

The coil conductor 20 preferably is provided on the front surface of the dielectric layer 16*c* and is made of a copper foil, for example. The coil conductor 20 includes linear conductive portions 26*a*-26*c* and connection conductive portions 28*a* and 28*b*. In a top-down planar view, the coil conductor 20 has a spiral shape spiraling clockwise from the center toward the outer circumference. In the following description, the upstream edge of the clockwise spiral of the coil conductor 20 or each of the linear conductive portions 26*a*-26*c* is referred to as an upstream edge, and the downstream edge of the clockwise spiral of the coil conductor 20 or each of the linear conductive portions 26*a*-26*c* is referred to as a downstream edge.

The linear conductive portion 26*a* has a length shorter than one turn and a line width of w4. Specifically, the linear conductive portion 26*a* extends along the left half of the front longer side, the left shorter side and the rear longer side of the dielectric layer 16*c*. The upstream edge of the linear conductive portion 26*a* is located near the center of the dielectric layer 16*c*. The downstream edge of the linear conductive portion 26*a* is located at the right rear corner of the dielectric layer 16*c*.

The linear conductive portion 26*b* has a length substantially corresponding to one turn and a line width of w3. The width w4 is smaller than the width w1 and is smaller than the width w3. In this preferred embodiment, the width w3 is equal or substantially equal to the width w1, and the width w4 is equal or substantially equal to the width w2. Specifically, the linear conductive portion 26*b* is arranged at the outer side of the linear conductive portion 26*a* to define an outer portion of the coil conductor 20 than the linear conductive portion 26*a*. The linear conductive portion 26*b* extends along the right shorter side, the front longer side, the left shorter side and the rear longer side of the dielectric layer 16*c*. Accordingly, the linear conductive portion 26*b* extends parallel or substantially parallel to the linear conductive portion 26*a* keeping a constant or substantially constant gap of w0 (see FIG. 3A) with the linear conductive portion 26*a*. The upstream edge and the downstream edge of the linear conductive portion 26*b* are located near the right rear corner of the dielectric layer 16*c*. The upstream edge of the linear conductive portion 26*b* and the downstream edge of the linear conductive portion 26*b* are separate from each other. The upstream edge of the linear conductive portion 26*b* is connected to the downstream edge of the linear conductive portion 26*a*.

The linear conductive portion 26*c* has a length shorter than one turn and a line width of w4. Specifically, the linear conductive portion 26*c* is arranged at the outer side of the linear conductive portion 26*b* to define an outer portion of the coil conductor 20 than the linear conductive portion 26*b*. The linear conductive portion 26*c* extends along the right shorter side and the front longer side of the dielectric layer 16*c*. Accordingly, the linear conductive portion 26*c* extends parallel or substantially parallel to the linear conductive portion 26*b* keeping a constant or substantially constant gap of w0 (see FIG. 3A) with the linear conductive portion 26*b*. The upstream edge of the linear conductive portion 26*c* is located at the right rear corner of the dielectric layer 16*c*. The downstream edge of the linear conductive portion 26*c* is located at the left front corner of the dielectric layer 16*c*. The upstream edge of the linear conductive portion 26*c* is connected to the downstream edge of the linear conductive portion 26*b*.

As described above, the linear conductive portion 26*a* having a line width of w4, the linear conductive portion 26*b* having a line width of w3 and the linear conductive portion 26*c* having a line width of w4 are connected in this order (that is, linear conductive portions having line widths of w4 and linear conductive portions having line widths of w3 are connected alternately) to define the coil conductor 20 in a spiral shape. The length of the linear conductive portion 26*a* is smaller than the length of the linear conductive portion 26*b*. Therefore, almost the entire length of the linear conductive portion 26*a* extends along the linear conductive portion 26*b*. The length of the linear conductive portion 26*c* is equal or substantially equal to the length of the linear conductive portion 26*b* (corresponding to about one turn). Therefore, almost the entire length of the linear conductive portion 26*b* extends along the linear conductive portion 26*c*. Accordingly, in the coil conductor 20, the linear conductive portion 26*a* having a line width of w4, the linear conductive portion 26*b* having a line width of w3 and the linear conductive portion 26*c* having a line width of w4 are arranged in this order (that is, linear conductive portions having line widths of w4 and linear conductive portions having line widths of w3 are arranged alternately) from the center toward the outer circumference. As illustrated in FIG. 3A, in the coil conductor 20, the linear conductive portion 26*a* having a line width of w4, the linear conductive portion 26*b* having a line width of w3 and the linear conductive portion 26*c* having a line width of w4 are arranged in this order (that is, linear conductive portions having line widths of w4 and linear conductive portions having line widths of w3 are arranged alternately) in a widthwise direction with uniform or substantially uniform gaps of w0 therebetween. The widthwise direction is a direction perpendicular or substantially perpendicular to the extending direction of the linear conductive portions 26*a*-26*c*. In FIG. 3A, the widthwise direction is the right-left direction, for example.

The connection conductive portion 28*a* is connected to the upstream edge of the linear conductive portion 26*a* and is located in the center of the dielectric layer 16*c*. The connection conductive portion 28*b* is connected to the downstream edge of the linear conductive portion 26*c* and is located at the left front corner of the dielectric layer 16*c*.

As seen in FIGS. 2, 3A and 3B, in a top-down planar view, the linear conductive portion 22*a* and the linear conductive portion 26*c* overlap each other. In a top-down planar view, the linear conductive portion 26*c* does not protrude from the linear conductive portion 26*a* in the widthwise direction. As seen in FIGS. 2, 3A and 3B, in a top-down planar view, the linear conductive portion 22*b* and the linear conductive portion 26*b* overlap each other. In a top-down planar view, the linear conductive portion 22*b* does not protrude from the linear conductive portion 26*b* in the widthwise direction.

As seen in FIGS. 3A and 3B, in a top-down planar view, the linear conductive portions 22*a*, 22*c* and 26*b* do not overlap one another. The linear conductive portions 22*a*, 22*c* and 26*b* are arranged in the widthwise direction with uniform or substantially uniform gaps of w10 therebetween.

The via-hole conductor v1 pierces through the dielectric layer 16*a* in the up-down direction to connect the external electrode 14*a* to the connection conductive portion 24*a*. The via-hole conductor v2 pierces through the dielectric layer 16*b* in the up-down direction to connect the connection conductive portion 24*b* to the connection conductive portion 28*a*. The via-hole conductors v3 and v4 pierce through the dielectric layers 16*a* and 16*b*, respectively, in the up-down direction to define one via-hole conductor. The via-hole conductor v3 is connected to the external electrode 14*b*, and the via-hole conductor v4 is connected to the connection conductive portion 28*b*. Accordingly, the coil L is connected between the external electrodes 14*a* and 14*b*.

With regard to the electronic component 10*a* having the structure above, the top surface is used as a mounting surface. Specifically, the electronic component 10*a* is mounted on a circuit board such that the top surface thereof faces the circuit board.

Figure 4:
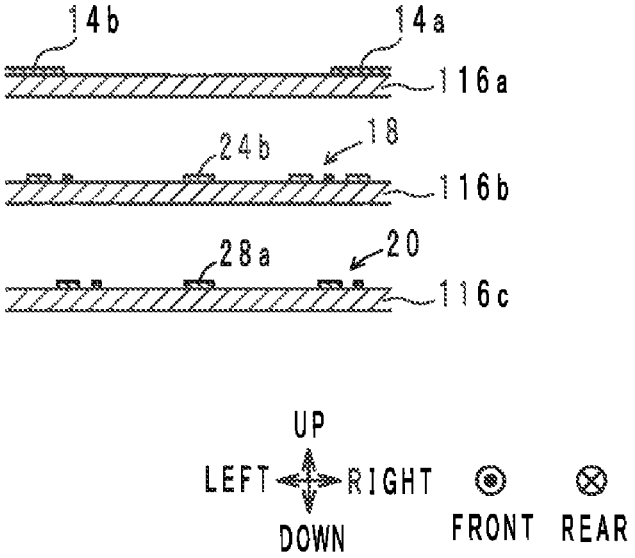
FIG. 4 is a sectional view of the electronic component indicating a step of a production process.
Figure 5:
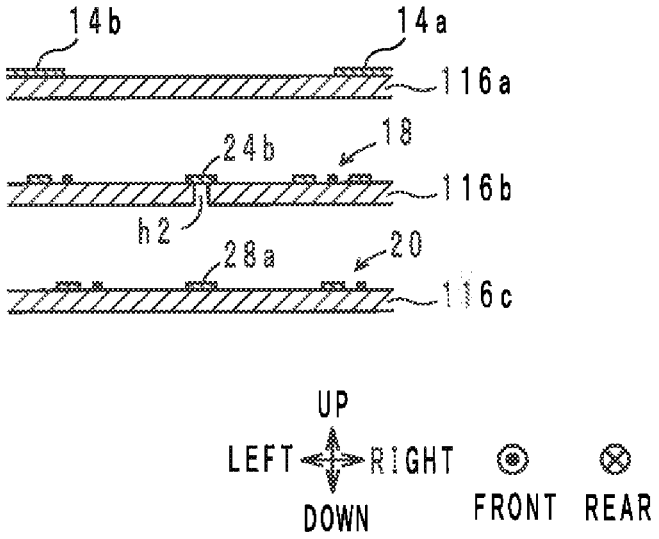
FIG. 5 is a sectional view of the electronic component indicating a step of a production process.
Figure 6:
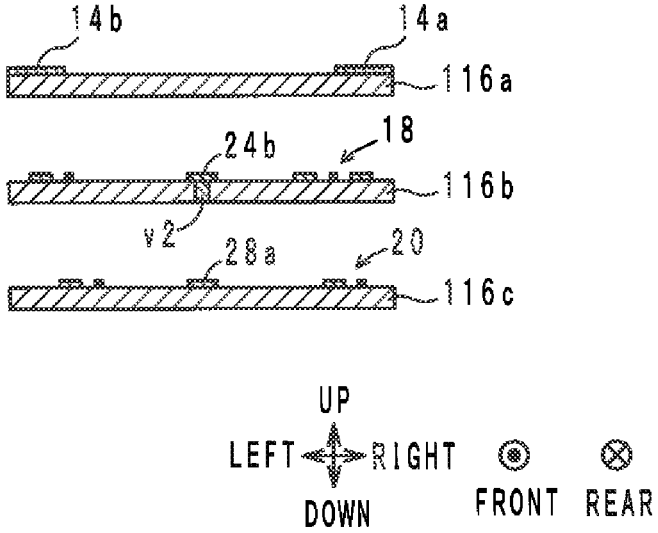
FIG. 6 is a sectional view of the electronic component indicating a step of a production process.

A non-limiting example of a production process of the electronic component 10*a* will hereinafter be described with reference to the drawings. FIGS. 4 through 6 are sectional views indicating steps of a production process of the electronic component 10*a*. In the following, a process of producing one electronic component 10*a* will be described as an example. Practically, however, a plurality of electronic components 10*a* preferably are produced at one time by stacking large-size dielectric sheets and by cutting the stacked body.

First, thermoplastic resin sheets 116*a*-116*c*, each having a copper foil (metal film) on the front surface, are prepared as sheets to be used as the dielectric layers 16*a*-16*c* respectively. The sheets 116*a*-116*c* to be used as the dielectric layers 16*a*-16*c* respectively are large-size sheets, each of which is large enough for a plurality of dielectric layers 16*a*, 16*b* or 16*c*. Copper foils are applied to the respective front surfaces of the sheets 116*a*-116*c*. The surfaces of the copper foils on the sheets 116*a*-116*c* are galvanized for corrosion control, and thereby, the surfaces of the copper foils are smoothened. The thermoplastic resin is liquid polymer, for example. The copper foils have thicknesses within a range from about 10 μm to about 20 μm, for example.

Next, as illustrated in FIG. 4, the copper foil on the front surface of the sheet 116*a* is patterned to form the external electrodes 14*a* and 14*b* on the sheet 116*a*. Specifically, on the front surface of the copper foil on the sheet 116*a*, resists having the same shapes of the external electrodes 14*a* and 14*b* indicated in FIG. 2 are printed. Then, the copper foil is etched, and the portion of the copper foil uncovered by the resists is removed. Thereafter, a resist remover is sprayed on the resists, and the resists are removed. In this way, the external electrodes 14*a* and 14*b* as indicated in FIG. 2 are formed on the front surface of the sheet 116*a* by photolithography.

Next, as illustrated in FIG. 4, the coil 18 is formed on the front surface of the sheet 116*b*. Also, the coil 20 is formed on the front surface of the sheet 116*c*. The processes of forming the coil conductors 18 and 20 are the same as the process of forming the external electrodes 14*a* and 14*b*, and description of the processes of forming the coil conductors 18 and 20 are omitted.

Next, as illustrated in FIG. 5, each of the sheets 116*a* and 116*b* is irradiated with a laser beam from the back surface, and thereby, through holes h1-h4 are formed. (Only the through hole h1 is indicated in FIG. 5.) Further, as illustrated in FIG. 6, the through holes h1-h4 are filled with a conductive paste.

Next, the sheets 116*a*-116*c* are stacked in this order from the top to the bottom, and the stack of sheets 116*a*-116*c* is subjected to a pressure-bonding treatment and a heating treatment. As a result, the boundary portions of the sheets 116*a*-116*c* are softened and melted, and thereafter solidified. In this way, the sheets 116*a*-116*c* are bonded together. In the meantime, the conductive paste filled in the through holes h1-h4 is solidified by the heat during the heating treatment, and thus, the via-hole conductors v1-v4 are formed. Through the process above, a mother multilayer body is obtained.

Next, the mother multilayer body is cut into a plurality of multilayer bodies 12. Thereafter, the copper foils 14 to be used as the external electrodes 14*a* and 14*b* are plated with Ni and Sn. Thus, the electronic component 10*a* is obtained.

In the electronic device 10*a* having the structure above, the linear conductive portions 22*b* and 26*c* are arranged to overlap the linear conductive portions 26*b* and 22*a*, respectively, without protruding in the widthwise direction. Accordingly, even if a stacking error occurs during fabrication of the multilayer body 12, the risk of protrusions of the linear conductive portions 22*b* and 26*c* from the linear conductive portions 26*b* and 22*a*, respectively, in the widthwise direction can be reduced. Consequently, the risk of a change in the square measure of the overlap area of the linear conductive portions 22*b* and 26*b* and a change in the square measure of the overlap area of the linear conductive portions 26*c* and 22*a* can be reduced. Hence, in the electronic component 10*a*, the risk of a change in the floating capacitance between the coil conductors 18 and 20 due to a stacking error during fabrication of the multilayer body 12 can be reduced.

Figure 7A:
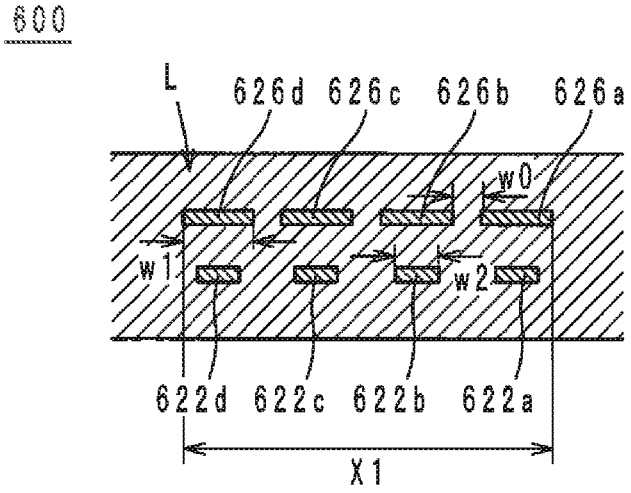
FIG. 7A is a sectional view of an electronic component according to a comparative example.
Figure 7B:
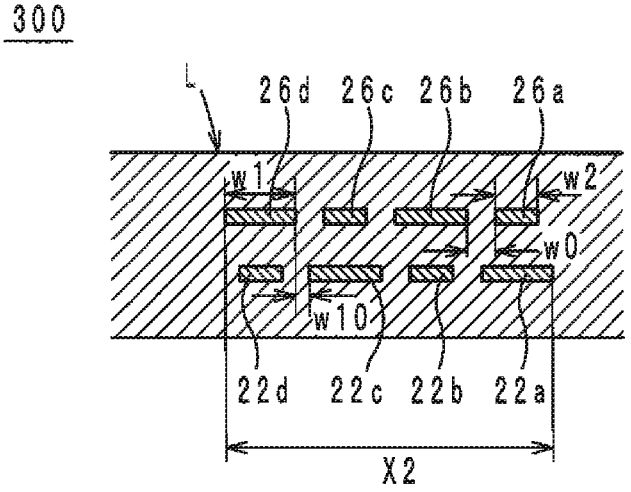
FIG. 7B is a sectional view of an electronic component having the same kind of structure as the electronic component according to the first preferred embodiment of the present invention.

Also, it is possible to downsize the electronic component 10*a* as will be described below. FIG. 7A is a sectional view of an electronic component 600 according to a comparative example. FIG. 7B is a sectional view of an electronic component 300 having the same kind of structure as the electronic component 10*a*.

First, the electronic component 600 according to the comparative example is described. In the electronic component 600 according to the comparative example, four linear conductive portions 622*a*-622*d* are arranged in the widthwise direction, and four linear conductive portions 626*a*-626*d* are arranged in the widthwise direction. The linear conductive portions 626*a*-626*d* have line widths of w1, and the linear conductive portions 622*a*-622*d* have line widths of w2. In a top-down planar view, the linear conductive portions 626*a*-626*d* are arranged in the widthwise direction with uniform or substantially uniform gaps of w0 therebetween.

Next, the electronic component 300 is described. The electronic component 300 has the same kind of structure as the electronic component 10*a*. However, the number of turns of the coil conductor 18 and the number of turns of the coil conductor 20 in the electronic component 300 are increased as compared to those in the electronic component 10*a*. In the electronic component 300, four linear conductive portions 22*a*-22*d* are arranged in the widthwise direction, and four linear conductive portions 26*a*-26*d* are arranged in the widthwise direction. The linear conductive portions 22*b*, 22*d*, 26*a* and 26*c* have line widths of w2, and the linear conductive portions 22*a*, 22*c*, 26*b* and 26*d* have line widths of w1. Thus, in the electronic component 300, the linear conductive portions 22*a* and 22*c* having relatively great line widths and the linear conductive portions 22*b* and 22*d* having relatively small line widths are arranged alternately in the widthwise direction. In the same way, the linear conductive portions 26*a* and 26*c* having relatively small line widths and the linear conductive portions 26*b* and 26*d* having relatively great line widths are arranged alternately in the widthwise direction. Also, the linear conductive portions 26*a*-26*d* overlap the linear conductive portions 22*a*-22*d*, respectively. In a top-down planar view, the linear conductive portion 26*a* is separate from the linear conductive portion 26*b* in the widthwise direction with a gap of w0. In a top-down planar view, the linear conductive portion 22*b* is separate from the linear conductive portion 22*c* in the widthwise direction with a gap of w0. In a top-down planar view, the linear conductive portion 26*c* is separate from the linear conductive portion 26*d* in the widthwise direction with a gap of w0. Also, in a top-down planar view, the linear conductive portion 22*a* is separate from the linear conductive portion 26*b* in the widthwise direction with a gap of w10. Likewise, in a top-down planar view, the linear conductive portion 22*c* is separate from the linear conductive portion 26*b* in the widthwise direction with a gap of w10. Also, in a top-down planar view, the linear conductive portion 22*c* is separate from the linear conductive portion 26*d* in the widthwise direction with a gap of w10.

In the electronic component 600 described above, the length (the dimension in the right-left direction) X1 of the space where the coil L is formed is expressed as follows.

$$X1=4\times w1+3\times w0 \quad (1)$$

In the electronic device 300 described above, the length (the dimension in the right-left direction) X2 of the space where the coil L is formed is expressed as follows.

$$X2=4\times w1+3\times w10 \quad (2)$$

The gaps w0 are determined to be such a value as to prevent a short circuit between each of the linear conductive portions 626*a*-626*d* and adjacent linear conductive portions. The gaps w10 are determined to be such a value as to reduce the risk of changes in the capacitance between the linear conductive portions 22*a* and 26*b*, in the capacitance between the linear conductive portions 22*c* and 26*b* and in the capacitance between the linear conductive portions 22*c* and 26*d*. In either of the electronic components 300 and 600, prevention of short circuits is more important than reduction of the risk of changes in the capacitance. Therefore, the gaps w0 are determined to be greater than the gaps w10. Accordingly, the length X2 is shorter than the length X1. Hence, the electronic component 300 (electronic component 10*a*) is made smaller than the electronic component 600.

In the electronic component 10*a*, the linear conductive portions 22*a*, 22*b* and 26*b* have lengths corresponding to substantially one turn. If the lengths of the linear conductive portions 22*a*, 22*b* and 26*b* are more than one turn, in the coil conductor 18, the linear conductive portion 22*a* having a line width of w1, the linear conductive portion 22*b* having a line width of w2 and the linear conductive portion 22*c* having a line width of w1 will not be arranged in this order in the widthwise direction. In this case, in the coil conductor 20 also, the linear conductive portion 26*a* having a line width of w4, the linear conductive portion 26*b* having a line width of w3 and the linear conductive portion 26*c* having a line width of w4 will not be arranged in this order in the widthwise direction. Therefore, the lengths of the linear conductive portions 22*a*-22*c* and 26*a*-26*c* need to be not more than one turn. Meanwhile, if the lengths of the linear conductive portions 22*a*-22*c* and 26*a*-26*c* are short, there will be more width-changing points. The characteristic impedances of the coil conductors 18 and 20 are likely to change at these width-changing points. For these reasons, the lengths of the linear conductive portions 22*a*-22*c* and 26*a*-26*c* are preferably not more than one turn and almost one turn. In consideration of this, in the electronic component 10*a*, the linear conductive portions 22*a*, 22*b* and 26*b* of all the linear conductive portions 22*a*-22*c* and 26*a*-26*c* have lengths substantially corresponding to one turn.

Since the dielectric layers 16*a*-16*c* are made of liquid crystal polymer, the electronic component 10*a* has an excellent passing characteristic. More specifically, the Q value of a capacitor using liquid crystal polymer as a dielectric is higher than the Q value of a capacitor using polyimide, ceramic or the like as a dielectric. The Q value of a capacitor means the ratio of energy stored in the capacitor to energy scattered and lost during one cycle of an alternating signal applied to the capacitor. Accordingly, having a higher Q value results in a smaller loss. Thus, in the electronic component 10*a*, since the dielectric layers 16*a*-16*c* are made of liquid crystal polymer, the loss of capacitance between the coil conductors 18 and 20 is significantly reduced. Therefore, the passing characteristic of the electronic component 10*a* is improved.

In the electronic component 10*a*, since the dielectric layers 16*a*-16*c* are made of a flexible material, bending of the multilayer body 12 causes the linear conductive portions 22*a*-22*c* to get closer to one another and the linear conductive portions 26*a*-26*c* to get closer to one another. Therefore, short circuits are likely to occur among the linear conductive portions 22*a*-22*c* and among the linear conductive portions 26*a*-26*c*. In order to prevent this trouble, it is preferred to increase the gaps w0 among the linear conductive portions 22*a*-22*c* and the gaps w0 among the linear conductive portions 26*a*-26*c*. However, increasing the gaps w0 results in an increase in the size of the electronic component 10*a*.

For this reason, in the electronic component 10*a*, the relatively wide linear conductive portion 22*a*, the relatively narrow linear conductive portion 22*b* and the relatively wide linear conductive portion 22*c* are arranged in this order in the widthwise direction. That is, relatively wide linear conductive portions and relatively narrow linear conductive portions are arranged alternately in the widthwise direction. Likewise, the relatively narrow linear conductive portion 26*a*, the relatively wide linear conductive portion 26*b* and the relatively narrow linear conductive portion 26*c* are arranged in this order in the widthwise direction. That is, relatively narrow linear conductive portions and relatively wide linear conductive portions are arranged alternately in the widthwise direction. Also, the linear conductive portions 26*a*-26*c* are arranged to overlap the linear conductive portions 22*a*-22*c*, respectively. As a result, as mentioned above, the electronic component 10*a* is downsized. Thus, by increasing the gaps w0 to such a degree not to increase the size of the electronic component 10*a*, both downsizing of the electronic component 10*a* and prevention of short circuits are achieved.

Further, the linear conductive portions 22*a* and 22*c* do not overlap the linear conductive portion 26*b* in a top-down planar view. Therefore, capacitance is unlikely to be generated between the linear conductive portion 22*a* and the linear conductive portion 26*b* and between the linear conductive portion 22*c* and the linear conductive portion 26*b*. Accordingly, even if a stacking error occurs during fabrication of the multilayer body 12, as long as the error is smaller than the gap w10, the capacitance between the linear conductive portion 22*a* and the linear conductive portion 26*b* and the capacitance between the linear conductive portion 22*c* and the linear conductive portion 26*b* hardly change.

In the electronic component 10*a*, the coil conductors 18 and 20 are spiral. Therefore, in either case in which a stacking error in the front-rear direction occurs or in which a stacking error in the right-left direction occurs, the change in the capacitance between the coil conductors 18 and 20 is significantly reduced or prevented.

Second Preferred Embodiment

Figure 8A:
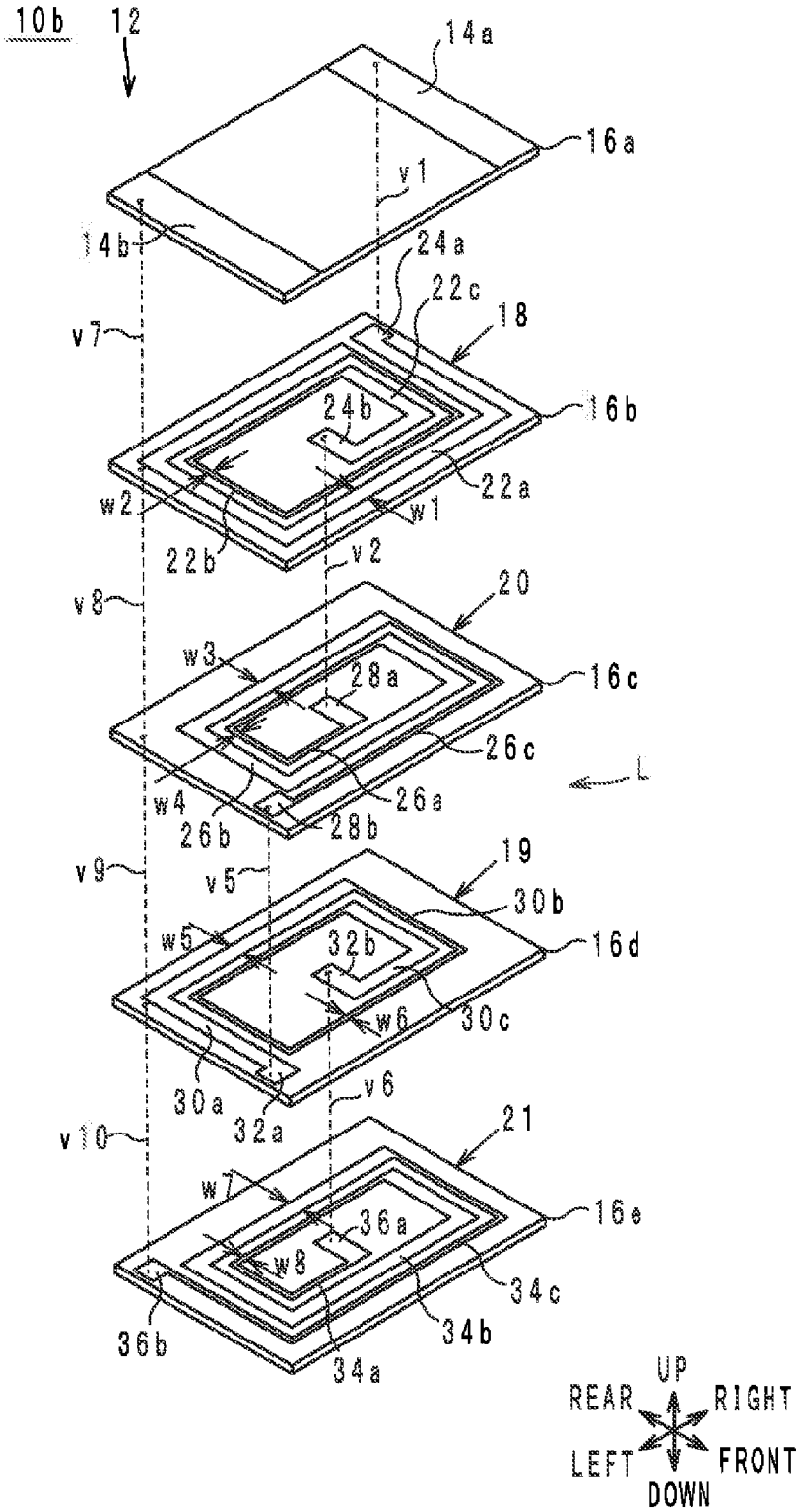
FIG. 8A is an exploded perspective view of an electronic component according to a second preferred embodiment of the present invention.
Figure 8B:
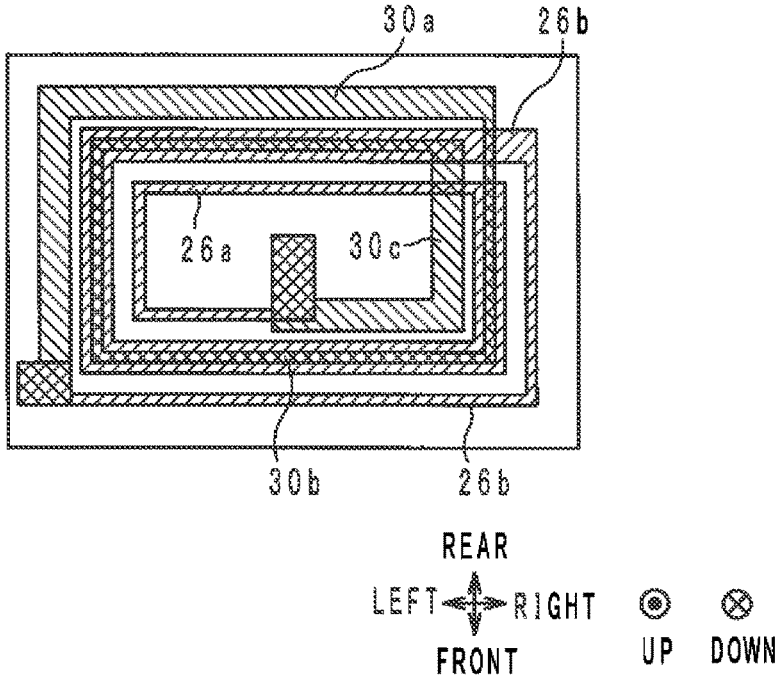
FIG. 8B is a plan view of coil conductors of the electronic component.
Figure 8C:
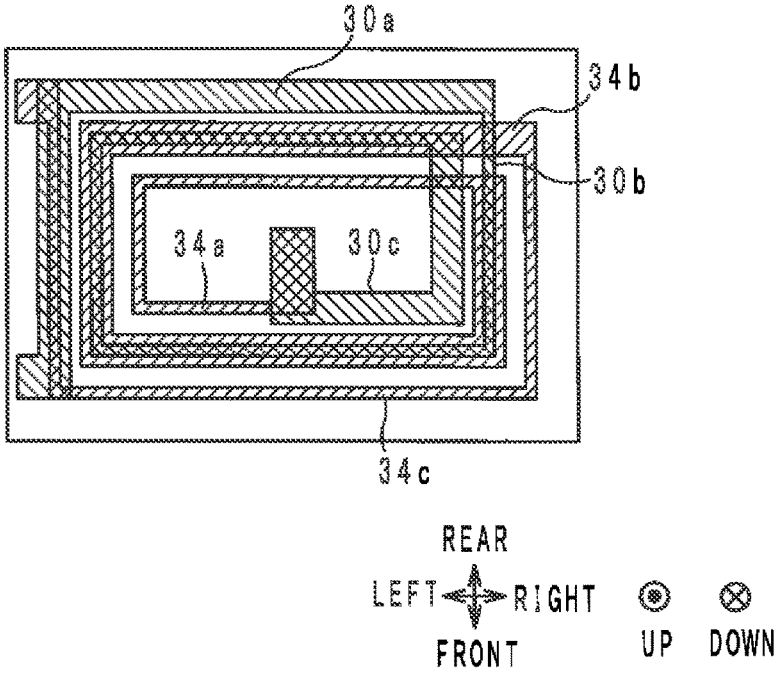
FIG. 8C is a plan view of the coil conductors of the electronic component.

An electronic component according to a second preferred embodiment of the present invention will hereinafter be described with reference to the drawings. FIG. 8A is a perspective view of the electronic component 10*b* according to the second preferred embodiment. FIG. 8B is a plan view of coil conductors 20 and 19 of the electronic component 10*b*. FIG. 8C is a plan view of the coil conductor 19 and a coil conductor of the electronic component 10*b*. The appearance of the electronic component 10*b* is as illustrated in FIG. 1.

The electronic component 10*b* differs from the electronic component 10*a* in that the coil conductors 19 and 21 are further provided. More specifically, the multilayer body 12 of the electronic component 10*b* includes dielectric layers 16*a*-16*e* stacked in this order from the top to the bottom. The coil L of the electronic component 10*b* includes the coil conductors 18, 20, 19 and 21 connected in series in this order.

The coil conductors 18 and 20 are provided on the front surfaces of the dielectric layers 16*b* and 16*c*, respectively. The coil conductors 18 and 20 of the electronic component 10*b* are the same as the coil conductors 18 and 20 of the electronic component 10*a*, and descriptions thereof are omitted.

The coil conductor 19 is provided on the front surface of the dielectric layer 16*d*, and is made of a copper foil, for example. The coil conductor 19 includes linear conductive portions 30*a*-30*c* and connection conductive portions 32*a* and 32*b*. In a top-down planar view, the coil conductor 19 has a spiral shape spiraling clockwise from the outer circumference toward the center. In the following description, the upstream edge of the clockwise spiral of the coil conductor 19 or each of the linear conductive portions 30*a*-30*c* is referred to as an upstream edge, and the downstream edge of the clockwise spiral of the coil conductor 19 or each of the linear conductive portions 30*a*-30*c* is referred to as a downstream edge.

The linear conductive portion 30*a* has a length shorter than one turn and a line width of w5. More specifically, the linear conductive portion 30*a* extends along the left shorter side and the rear longer side of the dielectric layer 16*d*. The upstream edge of the linear conductive portion 30*a* is located near the left front corner of the dielectric layer 16*d*. The downstream edge of the linear conductive portion 30*a* is located near the right rear corner of the dielectric layer 16*d*.

The linear conductive portion 30*b* has a length substantially corresponding to one turn and a line width of w6. The width w6 is smaller than the width w5. Specifically, the linear conductive portion 30*b* is arranged at the inner side of the linear conductive portion 30*a* to define an inner portion of the spiral coil conductor 19 than the linear conductive portion 30*a*. The linear conductive portion 30*b* extends along the right shorter side, the front longer side, the left shorter side and the rear longer side of the dielectric layer 16*d*. Accordingly, the linear conductive portion 30*b* extends parallel or substantially parallel to the linear conductive portion 30*a* keeping a constant or substantially constant gap of w0 with the linear conductive portion 30*a*. The upstream edge and the downstream edge of the linear conductive portion 30*b* are located near the right rear corner of the dielectric layer 16*d*. However, the upstream edge of the linear conductive portion 30*b* and the downstream edge of the linear conductive portion 30*b* are separate from each other. Also, the upstream edge of the linear conductive portion 30*b* is connected to the downstream edge of the linear conductive portion 30*a*.

The linear conductive portion 30*c* has a length shorter than one turn and a line width of w5. Specifically, the linear conductive portion 30*c* is arranged at the inner side of the linear conductive portion 30*b* to define an inner portion of the spiral coil conductor 19 than the linear conductive portion 30*b*. The linear conductive portion 30*c* extends along the right shorter side and the right half of the front longer side of the dielectric layer 16*d*. Accordingly, the linear conductive portion 30*c* extends parallel or substantially parallel to the linear conductive portion 30*b* keeping a constant or substantially constant gap of w0 with the linear conductive portion 30*b*. The upstream edge of the linear conductive portion 30*c* is located near the right rear corner of the dielectric layer 16*d*. The downstream edge of the linear conductive portion 30*c* is located near the center of the dielectric layer 16*d*. The upstream edge of the linear conductive portion 30*c* is connected to the downstream edge of the linear conductive portion 30*b*.

The connection conductive portion 32*a* is connected to the upstream edge of the linear conductive portion 30*a*, and is located at the left front corner of the dielectric layer 16*d*. The connection conductive portion 32*b* is connected to the downstream edge of the linear conductive portion 30*c*, and is located in the center (on the intersection point of the diagonal lines) of the dielectric layer 16*d*.

The coil conductor 21 is provided on the front surface of the dielectric layer 16*e*, and is made of a copper foil, for example. The coil conductor 21 includes linear conductive portions 34*a*-34*c* and connection conductive portions 36*a* and 36*b*. In a top-down planar view, the coil conductor 21 has a spiral shape spiraling clockwise from the center toward the outer circumference. In the following description, the upstream edge of the clockwise spiral of the coil conductor 21 or each of the linear conductive portions 34*a*-34*c* is referred to as an upstream edge, and the downstream edge of the clockwise spiral of the coil conductor 21 or each of the linear conductive portions 34*a*-34*c* is referred to as a downstream edge.

The linear conductive portion 34*a* has a length shorter than one turn and a line width of w8. Specifically, the linear conductive portion 34*a* extends along the left half of the front longer side, the left shorter side and the rear longer side of the dielectric layer 16*e*. The upstream edge of the linear conductive portion 34*a* is located near the center of the dielectric layer 16*e*. The downstream edge is located near the right rear corner of the dielectric layer 16*e*.

The linear conductive portion 34*b* has a length substantially corresponding to one turn and a line width of w7. The width w8 is smaller than the width w5 and smaller than the width w7. In the second preferred embodiment, the width w7 is equal or substantially equal to the width w1 and the width w5, and the width w8 is equal or substantially equal to the width w2 and the width w6. Specifically, the linear conductive portion 34*b* is arranged at the outer side of the linear conductive portion 34*a* to define an outer portion of the spiral coil conductor 21 than the linear conductive portion 34*a*. The linear conductive portion 34*b* extends along the right shorter side, the front longer side, the left shorter side and the rear longer side of the dielectric layer 16*e*. Accordingly, the linear conductive portion 34*b* extends parallel or substantially parallel to the linear conductive portion 34*a* keeping a constant or substantially constant gap of w0 with the linear conductive portion 34*a*. The upstream edge and the downstream edge of the linear conductive portion 34*b* are located near the right rear corner of the dielectric layer 16*e*. However, the upstream edge of the linear conductive portion 34*b* and the downstream edge of the linear conductive portion 34*b* are separate from each other. The upstream edge of the linear conductive portion 34*b* is connected to the downstream edge of the linear conductive portion 34*a*.

The linear conductive portion 34*c* has a length shorter than one turn and a line width of w8. Specifically, the linear conductive portion 34*c* is arranged at the outer side of the linear conductive portion 34*b* to define an outer portion of the spiral coil conductor 21 than the linear conductive portion 34*b*. The linear conductive portion 34*c* extends along the right shorter side, the front longer side and the left shorter side of the dielectric layer 16*e*. Accordingly, the linear conductive portion 34*c* extends parallel or substantially parallel to the linear conductive portion 34*b* keeping a constant or substantially constant gap of w0 with the linear conductive portion 34*b*. The upstream edge of the linear conductive portion 34*c* is located near the right rear corner of the dielectric layer 16*e*. The downstream edge of the linear conductive portion 34*c* is located near the left rear corner of the dielectric layer 16*e*. The upstream edge of the linear conductive portion 34*c* is connected to the downstream edge of the linear conductive portion 34*b*.

The connection conductive portion 36*a* is connected to the upstream edge of the linear conductive portion 34*a*, and is located in the center of the dielectric layer 16*e*. The connection conductive portion 36*b* is connected to the downstream edge of the linear conductive portion 34*c*, and is located at the left rear corner of the dielectric layer 16*e*.

As seen in FIGS. 8A and 8B, in a top-down planar view, the linear conductive portion 30*b* and the linear conductive portion 26*b* overlap each other. In a top-down planar view, the linear conductive portion 30*b* does not protrude from the linear conductive portion 26*b* in the widthwise direction.

As seen in FIGS. 8A and 8C, in a top-down planar view, the linear conductive portion 30*a* and the linear conductive portion 34*c* overlap each other. In a top-down planar view, the linear conductive portion 34*c* does not protrude from the linear conductive portion 30*a* in the widthwise direction. As seen in FIGS. 8A and 8C, in a top-down planar view, the linear conductive portion 30*b* and the linear conductive portion 34*b* overlap each other. In a top-down planar view, the linear conductive portion 30*b* does not protrude from the linear conductive portion 34*b* in the widthwise direction.

A via-hole conductor v5 pierces through the dielectric layer 16*c* in the up-down direction to connect the connection conductive portion 28*b* to the connection conductive portion 32*a*. A via-hole conductor v6 pierces through the dielectric layer 16*d* in the up-down direction to connect the connection conductive portion 32*b* to the connection conductive portion 36*a*. Via-hole conductors v7-v10 pierce through the dielectric layers 16*a*-16*d*, respectively, in the up-down direction to define one via-hole conductor. The via-hole conductor v7 is connected to the external electrode 14*b*, and the via-hole conductor v10 is connected to the connection conductive portion 36*b*. Accordingly, the coil L is connected between the external electrodes 14*a* and 14*b*.

The electronic component 10*b* having the structure above has the same effects as the electronic component 10*a*.

Third Preferred Embodiment

Figure 9:
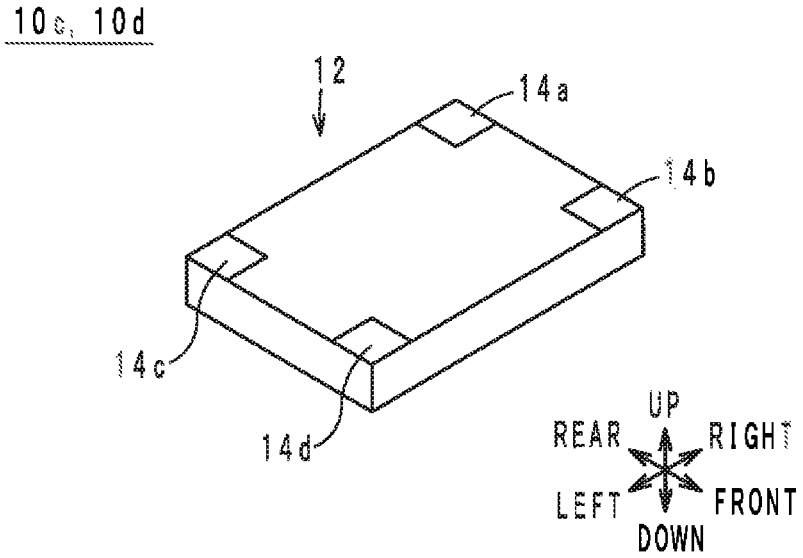
FIG. 9 is a perspective view of an electronic component according to a third preferred embodiment of the present invention.
Figure 10A:
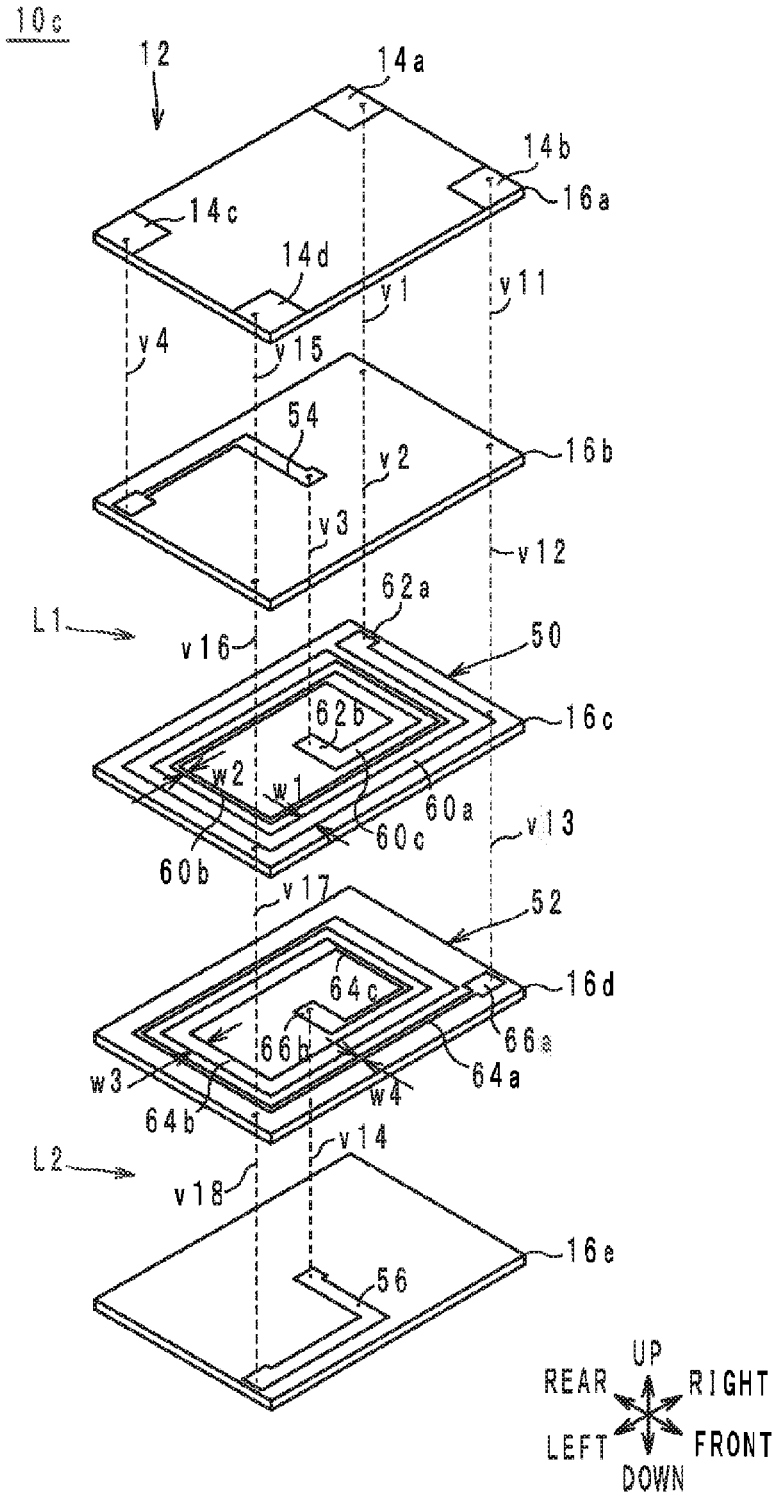
FIG. 10A is an exploded perspective view of an electronic component according to a third preferred embodiment of the present invention.
Figure 10B:
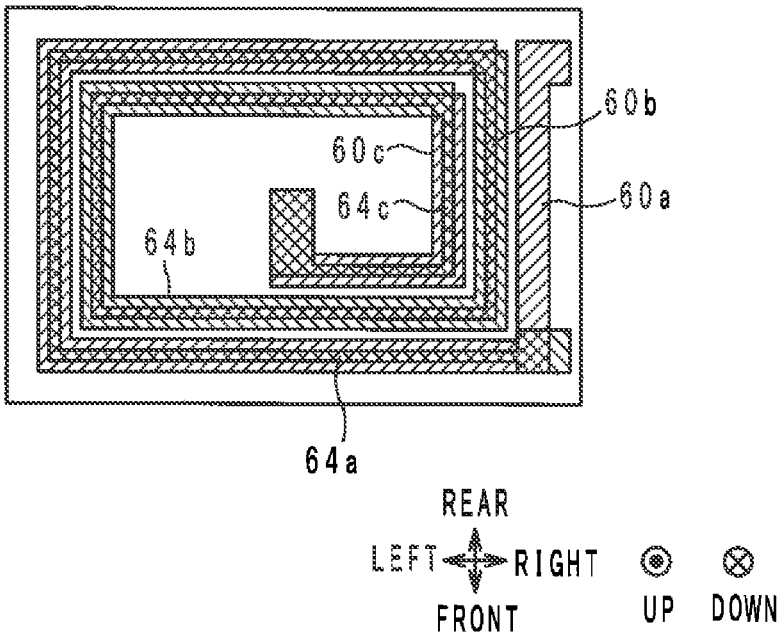
FIG. 10B is a plan view of coil conductors of the electronic component.

An electronic component according to a third preferred embodiment of the present invention will hereinafter be described with reference to the accompanying drawings. FIG. 9 is a perspective view of the electronic component 10*c* according to the third preferred embodiment. FIG. 10A is an exploded perspective view of the electronic component 10*c* according to the third preferred embodiment. FIG. 10B is a plan view of coil conductors 50 and 52 of the electronic component 10*c*.

The electronic component 10*c* includes a multilayer body 12, external electrodes 14*a*-14*d*, and coils L1 and L2. As seen in FIGS. 9 and 10A, the multilayer body 12 is a rectangular or substantially rectangular plate in a top-down planar view. The multilayer body 12 includes dielectric (insulating) layers 16*a*-16*e* stacked in this order from the top to the bottom. The dielectric layers 16*a*-16*e* are rectangular or substantially rectangular and are made of a flexible dielectric material, for example, liquid crystal polymer. Since the dielectric layers 16*a*-16*e* are flexible, the multilayer body 12 is flexible. In the following description, the upper surface of each of the dielectric layers 16*a*-16*e* is referred to as a front surface, and the lower surface of each of the dielectric layers 16*a*-16*e* is referred to as a back surface.

The external electrodes 14*a*-14*d* are provided on the front surface of the dielectric layer 16*a*, and the external electrodes 14*a*-14*d* are rectangular or substantially rectangular. The external electrode 14*a* is arranged at the right rear corner of the dielectric layer 16*a*. The external electrode 14*b* is arranged at the right front corner of the dielectric layer 16*a*. The external electrode 14*c* is arranged at the left rear corner of the dielectric layer 16*a*. The external electrode 14*d* is arranged at the left front corner of the dielectric layer 16*a*. The external electrodes 14*a*-14*d* are formed, for example, by plating a copper foil with Ni and Sn.

The coil L1 and the coil L2 are coupled to each other electromagnetically so as to define a common-mode choke coil.

The coil L1 includes a coil conductor 50, a lead conductor 54 and via-hole conductors v1-v4. The coil conductor 50 is provided on the front surface of the dielectric layer 16*c* and is made of a copper foil, for example. The coil conductor 50 includes linear conductive portions 60*a*-60*c* and connection conductive portions 62*a* and 62*b*. In a top-down planar view, the coil conductor 50 has a spiral shape spiraling clockwise from the outer circumference toward the center. In the following description, the upstream edge of the clockwise spiral of the coil conductor 50 or each of the linear conductive portions 60*a*-60*c* is referred to as an upstream edge, and the downstream edge of the clockwise spiral of the coil conductor 50 or each of the linear conductive portions 60*a*-60*c* is referred to as a downstream edge.

The linear conductive portion 60*a* has a length substantially corresponding to one turn and a line width of w1. Specifically, the linear conductive portion 60*a* extends along the right shorter side, the front longer side, the left shorter side and the rear longer side of the dielectric layer 16*c*. The upstream edge and the downstream edge of the linear conductive portion 60*a* are located near the right rear corner of the dielectric layer 16*c*. However, the upstream edge of the linear conductive portion 60*a* and the downstream edge of the linear conductive portion 60*b* are separate from each other.

The linear conductive portion 60*b* has a length substantially corresponding to one turn and a line width of w2. The width w2 is smaller than the width w1. Specifically, the linear conductive portion 60*b* is arranged at the inner side of the linear conductive portion 60*a* to define an inner portion of the spiral coil conductor 50 than the linear conductive portion 60*a*. The linear conductive portion 60*b* extends along the right shorter side, the front longer side, the left shorter side and the rear longer side of the dielectric layer 16*c*. Accordingly, the linear conductive portion 60*b* extends parallel or substantially parallel to the linear conductive portion 60*a* keeping a constant or substantially constant gap of w0 with the linear conductive portion 60*a*. The upstream edge and the downstream edge of the linear conductive portion 60*b* are located near the right rear corner of the dielectric layer 16*c*. However, the upstream edge of the linear conductive portion 60*b* and the downstream edge of the linear conductive portion 60*b* are separate from each other. The upstream edge of the linear conductive portion 60*b* is connected to the downstream edge of the linear conductive portion 60*a*.

The linear conductive portion 60*c* has a length shorter than one turn and a line width of w1. Specifically, the linear conductive portion 60*c* is arranged at the inner side of the linear conductive portion 60*b* to define an inner portion of the spiral coil conductor 50 than the linear conductive portion 60*b*. The linear conductive portion 60*c* extends along the right shorter side and the right half of the front longer side of the dielectric layer 16*c*. Accordingly, the linear conductive portion 60*c* extends parallel or substantially parallel to the linear conductive portion 60*b* keeping a constant or substantially constant gap of w0 with the linear conductive portion 60*b*. The upstream edge of the linear conductive portion 60*c* is located near the right rear corner of the dielectric layer 16*c*. The downstream edge of the linear conductive portion 60*c* is near the center of the dielectric layer 16*c*. The upstream edge of the linear conductive portion 60*c* is connected to the downstream edge of the linear conductive portion 60*b*.

As described above, the linear conductive portion 60*a* having a line width of w1, the linear conductive portion 60*b* having a line width of w2 and the linear conductive portion 60*c* having a line width of w2 are connected in this order (that is, linear conductive portions having line widths of w1 and linear conductive portions having line widths of w2 are connected alternately), thus defining the coil conductor 50 in a spiral shape. The length of the linear conductive portion 60*c* is smaller than the length of the linear conductive portion 60*b*. Therefore, almost the entire length of the linear conductive portion 60*c* extends along the linear conductive portion 60*b*. The length of the linear conductive portion 60*a* is equal or substantially equal to the length of the linear conductive portion 60*b* and substantially corresponds to one turn. Therefore, almost the entire length of the linear conductive portion 60*a* extends along the linear conductive portion 60*b*. Accordingly, in the coil conductor 50, the linear conductive portion 60*a* having a line width of w1, the linear conductive portion 60*b* having a line width of w2 and the linear conductive portion 60*c* having a line width of w1 are arranged in this order from the outer circumference toward the center. In other words, in the coil conductor 50, linear conductive portions having line widths of w1 and linear conductive portions having line widths of w2 are arranged alternately in the widthwise direction with uniform or substantially uniform gaps of w0 therebetween. The widthwise direction is a direction perpendicular or substantially perpendicular to the extending direction of the linear conductive portions 60*a*-60*c*.

The connection conductive portion 62*a* is connected to the upstream edge of the linear conductive portion 60*a* and is located at the rear right corner of the dielectric layer 16*c*. The connection conductive portion 62*b* is connected to the downstream edge of the linear conductive portion 60*c* and is located in the center (on the intersection point of the diagonal lines) of the dielectric layer 16*c*.

The lead conductor 54 is a linear conductor provided on the front surface of the dielectric layer 16*b* and made of a copper foil, for example. An end of the lead conductor 54 overlaps the connection conductive portion 62*b* in a top-down planar view. The other end of the lead conductor 54 overlaps the external electrode 14*c* in a top-down planar view.

The via-hole conductors v1 and v2 pierce through the dielectric layers 16*a* and 16*b*, respectively, in the up-down direction to define one via-hole conductor. The via-hole conductor v1 is connected to the external electrode 14*a*, and the via-hole conductor v2 is connected to the connection conductive portion 62*a*. The via-hole conductor v3 pierces through the dielectric layer 16*b* in the up-down direction to connect the connection conductive portion 62*b* to one end of the lead conductor 54. The via-hole conductor v4 pierces through the dielectric layer 16*a* in the up-down direction to connect the other end of the lead conductor 54 to the external electrode 14*c*. Accordingly, the coil L1 is connected between the external electrodes 14*a* and 14*c*.

The coil L2 includes a coil conductor 52, a lead conductor 56 and via-hole conductors v11-v18. The coil conductor 52 is provided on the front surface of the dielectric layer 16*d* and is made of a copper foil, for example. The coil conductor 52 includes linear conductive portions 64*a*-64*c* and connection conductive portions 66*a* and 66*b*. In a top-down planar view, the coil conductor has a spiral shape spiraling clockwise from the outer circumference toward the center. In the following description, the upstream edge of the clockwise spiral of the coil conductor 52 or each of the linear conductive portions 64*a*-64*c* is referred to as an upstream edge, and the downstream edge of the clockwise spiral of the coil conductor 52 or each of the linear conductive portions 64*a*-64*c* is referred to as a downstream edge.

The linear conductive portion 64*a* has a length shorter than one turn and a line width of w4. Specifically, the linear conductive portion 64*a* extends along the front longer side, the left shorter side and the rear longer side of the dielectric layer 16*d*. The upstream edge of the linear conductive portion 64*a* is located near the right front corner of the dielectric layer 16*d*. The downstream edge of the linear conductive portion 64*a* is located near the right rear corner of the dielectric layer 16*d*.

The linear conductive portion 64*b* has a length substantially corresponding to one turn and a line width of w3. The width w4 is smaller than the width w3. Specifically, the linear conductive portion 64*b* is arranged at the inner side of the linear conductive portion 64*a* to define an inner portion of the spiral coil conductor 52 than the linear conductive portion 64*a*. The linear conductive portion 64*b* extends along the right shorter side, the front longer side, the left shorter side and the rear longer side of the dielectric layer 16*d*. Accordingly, the linear conductive portion 64*b* extends parallel or substantially parallel to the linear conductive portion 64*a* keeping a constant or substantially constant gap of w0 with the linear conductive portion 64*a*. The upstream edge and the downstream edge of the linear conductive portion 64*b* are located near the right rear corner of the dielectric layer 16*d*. However, the upstream edge of the linear conductive portion 64*b* and the downstream edge of the linear conductive portion 64*b* are separate from each other. The upstream edge of the linear conductive portion 64*b* is connected to the downstream edge of the linear conductive portion 64*a*.

The linear conductive portion 64*c* has a length shorter than one turn and a line width of w4. Specifically, the linear conductive portion 64*c* is arranged at the inner side of the linear conductive portion 64*b* to define an inner portion of the spiral coil conductor 52 than the linear conductive portion 64*b*. The linear conductive portion 64*c* extends along the right shorter side and the right half of the front longer side of the dielectric layer 16*d*. Accordingly, the linear conductive portion 64*c* extends parallel or substantially parallel to the linear conductive portion 64*b* keeping a constant or substantially constant gap of w0 with the linear conductive portion 64*b*. The upstream edge of the linear conductive portion 64*c* is located near the right rear corner of the dielectric layer 16*d*. The downstream edge of the linear conductive portion 64*c* is near the center of the dielectric layer 16*d*. The upstream edge of the linear conductive portion 64*c* is connected to the downstream edge of the linear conductive portion 64*b*.

As described above, the linear conductive portion 64*a* having a line width of w4, the linear conductive portion 64*b* having a line width of w3 and the linear conductive portion 64*c* having a line width of w4 are connected in this order (that is, linear conductive portions having line widths of w4 and linear conductive portions having line widths of w3 are connected alternately), thus defining conductor 52 in a spiral shape. The length of the linear conductive portion 64*c* is smaller than the length of the linear conductive portion 64*b*. Therefore, almost the entire length of the linear conductive portion 64*c* extends along the linear conductive portion 64*b*. The length of the linear conductive portion 64*a* is smaller than the length of the linear conductive portion 64*b*. Therefore, almost the entire length of the linear conductive portion 64*a* extends along the linear conductive portion 64*b*. Accordingly, in the coil conductor 52, the linear conductive portion 64*a* having a line width of w4, the linear conductive portion 64*b* having a line width of w3 and the linear conductive portion 64*c* having a line width of w4 are arranged in this order from the outer circumference toward the center. In other words, in the coil conductor 52, linear conductive portions having line widths of w4 and linear conductive portions having line widths of w3 are arranged alternately in the widthwise direction with uniform or substantially uniform gaps of w0 therebetween. The widthwise direction is a direction perpendicular or substantially perpendicular to the extending direction of the linear conductive portions 64*a*-64*c*.

The connection conductive portion 66*a* is connected to the upstream edge of the linear conductive portion 64*a* and is located at the right front corner of the dielectric layer 16*d*. The connection conductive portion 66*b* is connected to the downstream edge of the linear conductive portion 64*c* and is located in the center (on the intersection point of the diagonal lines) of the dielectric layer 16*d*.

The lead conductor 56 is a linear conductor provided on the front surface of the dielectric layer 16*e* and made of a copper foil, for example. An end of the lead conductor 56 overlaps the connection conductive portion 66*b* in a top-down planar view. The other end of the lead conductor 54 overlaps the external electrode 14*d* in a top-down planar view.

As seen in FIG. 10B, in a top-down planar view, the linear conductive portion 60*a* and the linear conductive portion 64*a* overlap each other. In a top-down planar view, the linear conductive portion 64*a* does not protrude from the linear conductive portion 60*a* in the widthwise direction. As seen in FIG. 10B, in a top-down planar view, the linear conductive portion 60*b* and the linear conductive portion 64*b* overlap each other. In a top-down planar view, the linear conductive portion 60*b* does not protrude from the linear conductive portion 64*b* in the widthwise direction. As seen in FIG. 10B, in a top-down planar view, the linear conductive portion 60*c* and the linear conductive portion 64*c* overlap each other. In a top-down planar view, the linear conductive portion 64*c* does not protrude from the linear conductive portion 60*c* in the widthwise direction.

The via-hole conductors v11-v13 pierce through the dielectric layers 16*a*-16*c*, respectively, in the up-down direction to define one via-hole conductor. The via-hole conductor v11 is connected to the external electrode 14*b*, and the via-hole conductor v13 is connected to the connection conductive portion 66*a*. The via-hole conductor v14 pierces through the dielectric layer 16*d* in the up-down direction to connect the connection conductive portion 66*b* to one end of the lead conductor 56. The via-hole conductors v15-v18 pierce through the dielectric layers 16*a*-16*d*, respectively, in the up-down direction to define one via-hole conductor. The via-hole conductor v15 is connected to the external electrode 14*d*, and the via-hole conductor v18 is connected to the other end of the lead conductor 56. Accordingly, the coil L2 is connected between the external electrodes 14*b* and 14*d*.

In the electronic component 10*c* having the structure above, the coils L1 and L2 are arranged to overlap each other in a top-down planar view. Therefore, magnetic fluxes generated from the coil L1 pass through the coil L2, and magnetic fluxes generated from the coil L2 pass through the coil L1. Accordingly, the coil L1 and the coil L2 are coupled to each other electromagnetically, and the coil L1 and the coil L2 define a common-mode choke coil. The external electrodes 14*a* and 14*b* are used as input terminals, and the external electrodes 14*c* and 14*d* are used as output terminals. Thus, differential transmission signals are input through the external electrodes 14*a* and 14*b* and output through the external electrodes 14*c* and 14*d*. If the differential transmission signals include common-mode noise, the common-mode noise will cause the coil L1 and the coil L2 to generate magnetic fluxes in the same direction. Therefore, the magnetic fluxes are enhanced by one another, thus generating impedance to the common-mode noise. Consequently, the common-mode noise is converted into heat. In this way, the electronic component 10*c* prevents common-monde noise from passing through the coils L1 and L2.

The electronic component 10*c* having the structure above has the same effects as the electronic component 10*a*.

In the electronic component 10*c*, the coil L1 and the coil L2 define a common-mode choke coil. In the electronic component 10*c*, the risk of a change in the capacitance between the coil conductor 50 and the coil conductor 52 is reduced, and therefore, the risk of a change in the coupling strength between the coil L1 and the coil L2 is reduced.

Fourth Preferred Embodiment

Figure 11A:
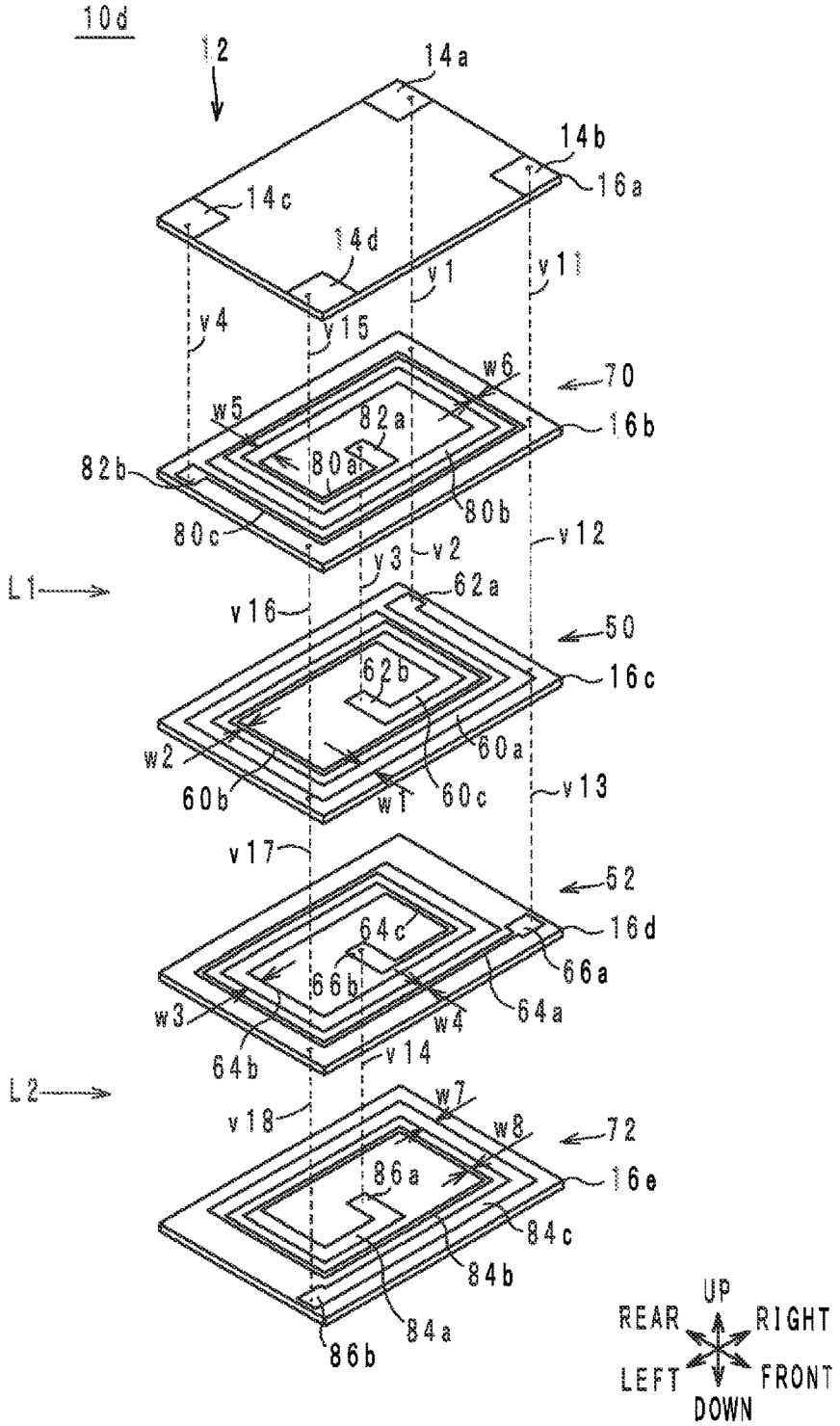
FIG. 11A is an exploded perspective view of an electronic component according to a fourth preferred embodiment of the present invention.
Figure 11B:
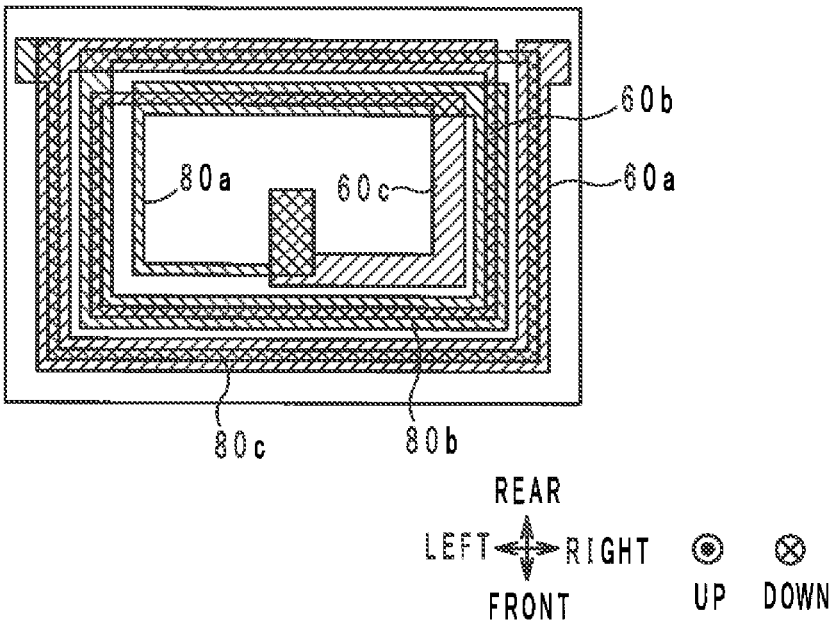
FIG. 11B is a plan view of coil conductors of the electronic component.
Figure 11C:
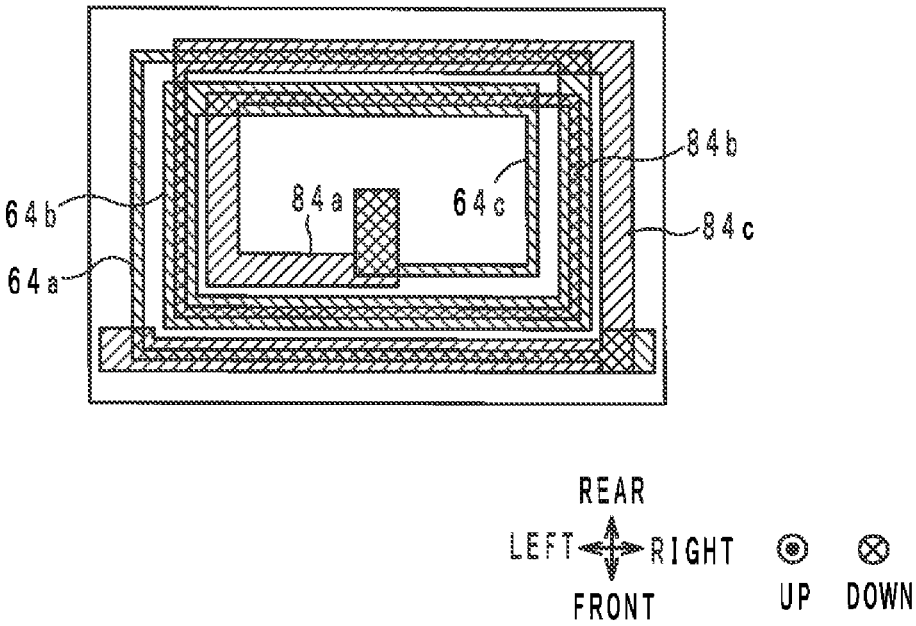
FIG. 11C is a plan view of the coil conductors of the electronic component.

An electronic component according to a fourth preferred embodiment of the present invention will hereinafter be described with reference to the drawings. FIG. 11A is an exploded perspective view of the electronic component 10*d* according to the fourth preferred embodiment. FIG. 11B is a plan view of coil conductors 50 and 70 of the electronic component 10*d*. FIG. 11C is a plan view of coil conductors 52 and 72 of the electronic component 10*d*. The appearance of the electronic component 10*d* is as illustrated in FIG. 9.

The electronic component 10*d* differs from the electronic component 10*c* in that the coil conductor 70 is provided instead of the lead conductor 54 and in that the coil conductor 72 is provided instead of the lead conductor 56.

The coil conductor 70 is provided on the front surface of the dielectric layer 16*b* and is made of a copper foil, for example. The coil conductor 70 includes linear conductive portions 80*a*-80*c*, and connection conductive portions 82*a* and 82*b*. In a top-down planar view, the coil conductor 70 has a spiral shape spiraling clockwise from the center toward the outer circumference. The upstream edge of the clockwise spiral of the coil conductor 70 or each of the linear conductive portions 80*a*-80*c* is referred to as an upstream edge, and the downstream edge of the clockwise spiral of the coil conductor 70 or each of the linear conductive portions 80*a*-80*c* is referred to as a downstream edge.

The linear conductive portion 80*a* has a length shorter than one turn and a line width of w6. Specifically, the linear conductive portion 80*a* extends along the left half of the front longer side and the left shorter side of the dielectric layer 16*b*. The upstream edge of the linear conductive portion 80*a* is located near the center of the dielectric layer 16*b*. The downstream edge of the linear conductive portion 80*a* is located at the left rear corner of the dielectric layer 16*b*.

The linear conductive portion 80*b* has a length substantially corresponding to one turn and a line width of w5. The width w6 is smaller than the width w5. In this preferred embodiment, the width w5 is equal or substantially equal to the width w1, and the width w6 is equal or substantially equal to the width w2. Specifically, the linear conductive portion 80*b* is arranged at the outer side of the linear conductive portion 80*a* to define an outer portion of the coil conductor 70 than the linear conductive portion 80*a*. The linear conductive portion 80*b* extends along the rear longer side, the right shorter side, the front longer side and the left shorter side of the dielectric layer 16*b*. Accordingly, the linear conductive portion 80*b* extends parallel or substantially parallel to the linear conductive portion 80*a* keeping a constant or substantially constant gap of w0 with the linear conductive portion 80*a*. The upstream edge and the downstream edge of the linear conductive portion 80*b* are located near the right rear corner of the dielectric layer 16*b*. However, the upstream edge of the linear conductive portion 80*b* and the downstream edge of the linear conductive portion 80*b* are separate from each other. The upstream edge of the linear conductive portion 80*b* is connected to the downstream edge of the linear conductive portion 80*a*.

The linear conductive portion 80*c* has a length substantially corresponding to one turn and a line width of w6. Specifically, the linear conductive portion 80*c* is arranged at the outer side of the linear conductive portion 80*b* to define an outer portion of the coil conductor 70 than the linear conductive portion 80*b*. The linear conductive portion 80*b* extends along the rear longer side, the right shorter side, the front longer side and the left shorter side of the dielectric layer 16*b*. Accordingly, the linear conductive portion 80*c* extends parallel or substantially parallel to the linear conductive portion 80*b* keeping a constant or substantially constant gap of w0 with the linear conductive portion 80*b*. The upstream edge and the downstream edge of the linear conductive portion 80*c* are located near the left rear corner of the dielectric layer 16*b*. However, the upstream edge of the linear conductive portion 80*c* and the downstream edge of the linear conductive portion 80*c* are separate from each other. The upstream edge of the linear conductive portion 80*c* is connected to the downstream edge of the linear conductive portion 80*b*.

The connection conductive portion 82*a* is connected to the upstream edge of the linear conductive portion 80*a* and is located in the center of the dielectric layer 16*b*. The connection conductive portion 82*b* is connected to the downstream edge of the linear conductive portion 80*c* and is located at the left rear corner of the dielectric layer 16*b*.

As seen in FIGS. 11A and 11B, in a top-down planar view, the linear conductive portion 80*b* and the linear conductive portion 60*b* overlap each other. In a top-down planar view, the linear conductive portion 60*b* does not protrude from the linear conductive portion 80*b* in the widthwise direction. As seen in FIGS. 11A and 11B, in a top-down planar view, the linear conductive portion 80*c* and the linear conductive portion 60*a* overlap each other. In a top-down planar view, the linear conductive portion 80*c* does not protrude from the linear conductive portion 60*a* in the widthwise direction.

The via-hole conductor v3 connects the connection conductive portion 82*a* to the connection conductive portion 62*a*. The via-hole conductor v4 connects the external electrode 14*c* to the connection conductive portion 82*c*. Accordingly, the coil L1 is connected between the external electrodes 14*a* and 14*c*.

The coil conductor 72 is provided on the front surface of the dielectric layer 16*f* and is made of a copper foil, for example. The coil conductor 72 includes linear conductive portions 84*a*-84*c*, and connection conductive portions 86*a* and 86*b*. In a top-down planar view, the coil conductor 72 spirals clockwise from the center toward the outer circumference. The upstream edge of the clockwise spiral of the coil conductor 72 or each of the linear conductive portions 86*a*-86*c* is referred to as an upstream edge, and the downstream edge of the clockwise spiral of the coil conductor 72 or each of the linear conductive portions 86*a*-86*c* is referred to as a downstream edge.

The linear conductive portion 84*a* has a length shorter than one turn and a line width of w7. Specifically, the linear conductive portion 84*a* extends along the front longer side and the left shorter side of the dielectric layer 16*f*. The upstream edge of the linear conductive portion 84*a* is located near the center of the dielectric layer 16*f*. The downstream edge of the linear conductive portion 84*a* is located near the left rear corner of the dielectric layer 16*f*.

The linear conductive portion 84*b* has a length substantially corresponding to one turn and a line width of w8. The width w8 is smaller than the width w7. In this preferred embodiment, the width w7 is equal or substantially equal to the widths w1 and w5, and the width w8 is equal or substantially equal to the widths w2 and w6. Specifically, the linear conductive portion 84*b* is arranged at the outer side of the linear conductive portion 84*a* to define an outer portion of the coil conductor 72 than the linear conductive portion 84*a*. The linear conductive portion 84*b* extends along the rear longer side, the right shorter side, the front longer side and the left shorter side of the dielectric layer 16*f*. Accordingly, the linear conductive portion 84*b* extends parallel or substantially parallel to the linear conductive portion 84*a* keeping a constant or substantially constant gap of w0 with the linear conductive portion 84*a*. The upstream edge and the downstream edge of the linear conductive portion 84*b* are located near the left rear corner of the dielectric layer 16*f*. However, the upstream edge of the linear conductive portion 84*b* and the downstream edge of the linear conductive portion 84*b* are separate from each other. The upstream edge of the linear conductive portion 84*b* is connected to the downstream edge of the linear conductive portion 84*a*.

The linear conductive portion 84*c* has a length shorter than one turn and a line width of w7. Specifically, the linear conductive portion 84*c* is arranged at the outer side of the linear conductive portion 84*b* to define an outer portion of the coil conductor 72 than the linear conductive portion 84*b*. The linear conductive portion 84*b* extends along the rear longer side, the right shorter side and the front longer side of the dielectric layer 16*f*. Accordingly, the linear conductive portion 84*c* extends parallel or substantially parallel to the linear conductive portion 84*b* keeping a constant or substantially constant gap of w0 with the linear conductive portion 84*b*. The upstream edge of the linear conductive portion 84*c* is located near the left rear corner of the dielectric layer 16*f*. The downstream edge of the linear conductive portion 84*c* is located near the left front corner of the dielectric layer 16*f*. The upstream edge of the linear conductive portion 84*c* is connected to the downstream edge of the linear conductive portion 84*b*.

The connection conductive portion 86*a* is connected to the upstream edge of the linear conductive portion 84*a* and is located in the center of the dielectric layer 16*f*. The connection conductive portion 86*b* is connected to the downstream edge of the linear conductive portion 84*c* and is located at the left front corner of the dielectric layer 16*f*.

As seen in FIGS. 11A and 11C, in a top-down planar view, the linear conductive portion 84*b* and the linear conductive portion 64*b* overlap each other. In a top-down planar view, the linear conductive portion 84*b* does not protrude from the linear conductive portion 64*b* in the widthwise direction. As seen in FIGS. 11A and 11C, in a top-down planar view, the linear conductive portion 84*c* and the linear conductive portion 64*a* overlap each other. In a top-down planar view, the linear conductive portion 64*a* does not protrude from the linear conductive portion 84*c* in the widthwise direction.

The via-hole conductor v14 connects the connection conductive portion 66*b* to the connection conductive portion 86*a*. The via-hole conductor v18 is connected to the connection conductive portion 86*b*. Accordingly, the coil L2 is connected between the external electrodes 14*b* and 14*d*.

The electronic component 10*d* having the structure above has the same effects as the electronic component 10*a*.

In the electronic component 10*d*, the coil L1 and the coil L2 define a common-mode choke coil. In the electronic component 10*d*, the risk of a change in the capacitance between the coil conductor 50 and the coil conductor 52 is reduced, and therefore, the risk of a change in the coupling strength between the coil L1 and the coil L2 is reduced.

Fifth Preferred Embodiment

Figure 12:
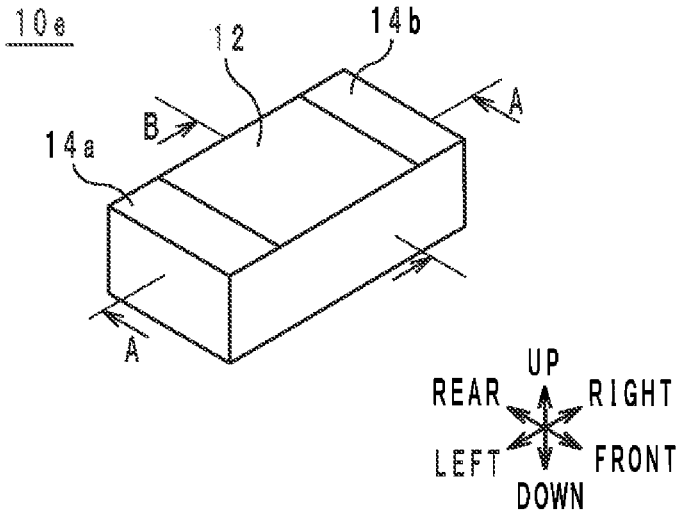
FIG. 12 is a perspective view of an electronic component according to a fifth preferred embodiment of the present invention.
Figure 13A:
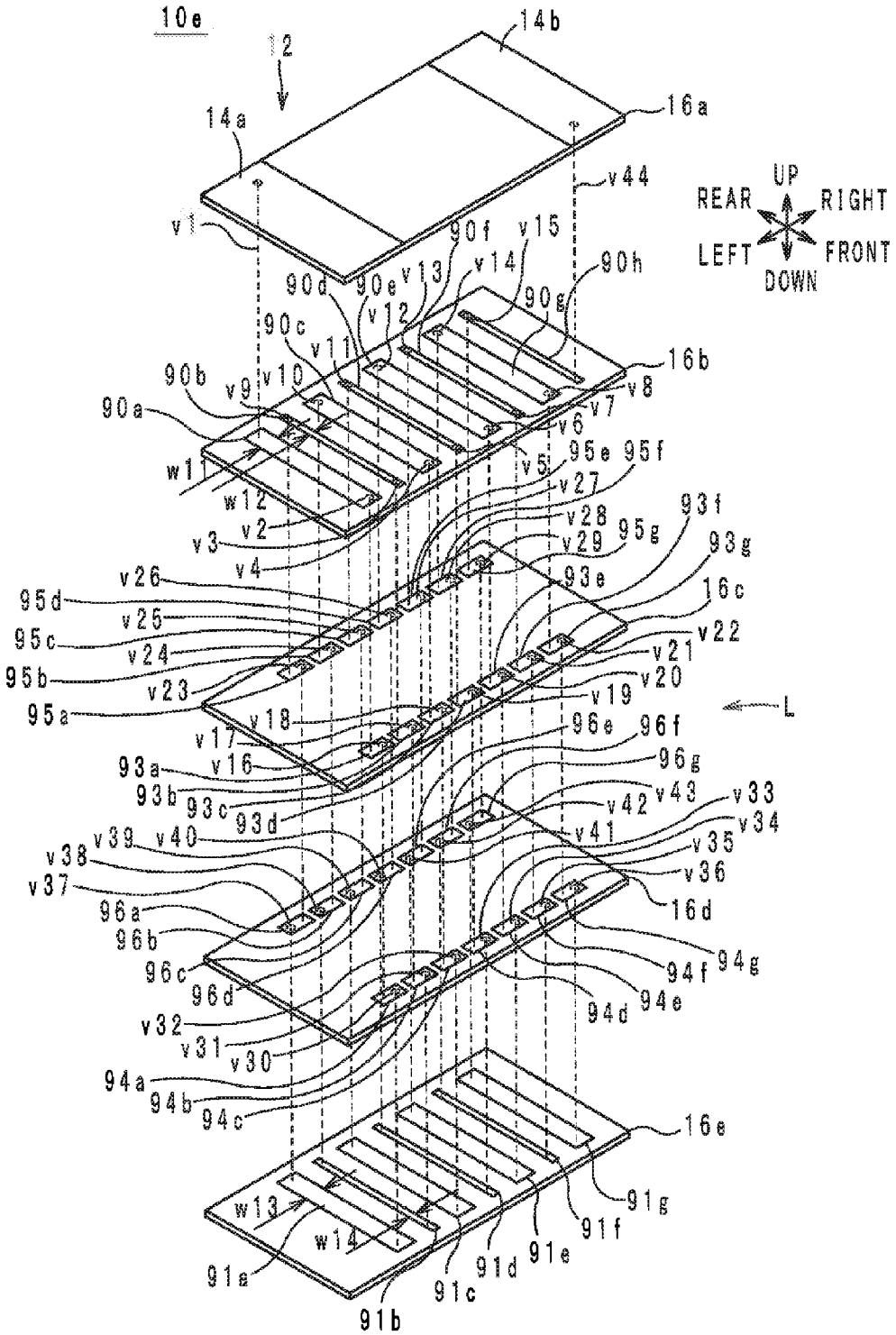
FIG. 13A is an exploded perspective view of the electronic component according to the fifth preferred embodiment of the present invention.
Figure 13B:
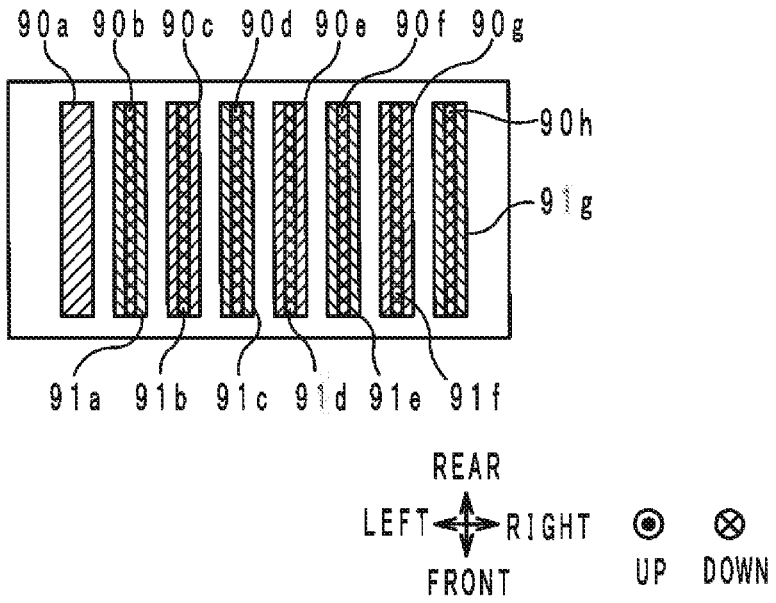
FIG. 13B is a plan view of linear conductors of the electronic component.
Figure 14:
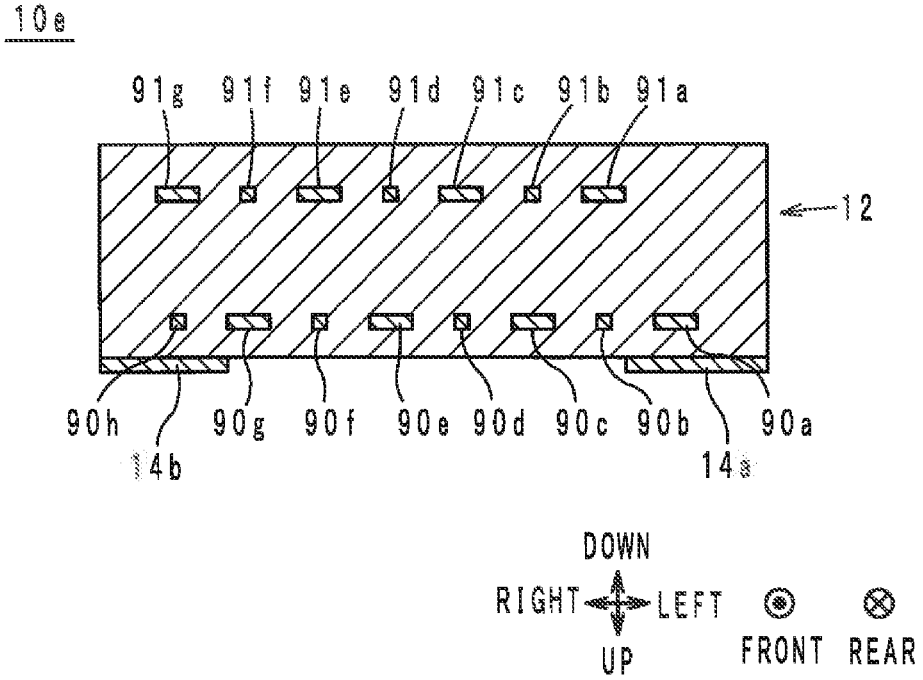
FIG. 14 is a sectional view of the electronic component cut along the line A-A.
Figure 15A:
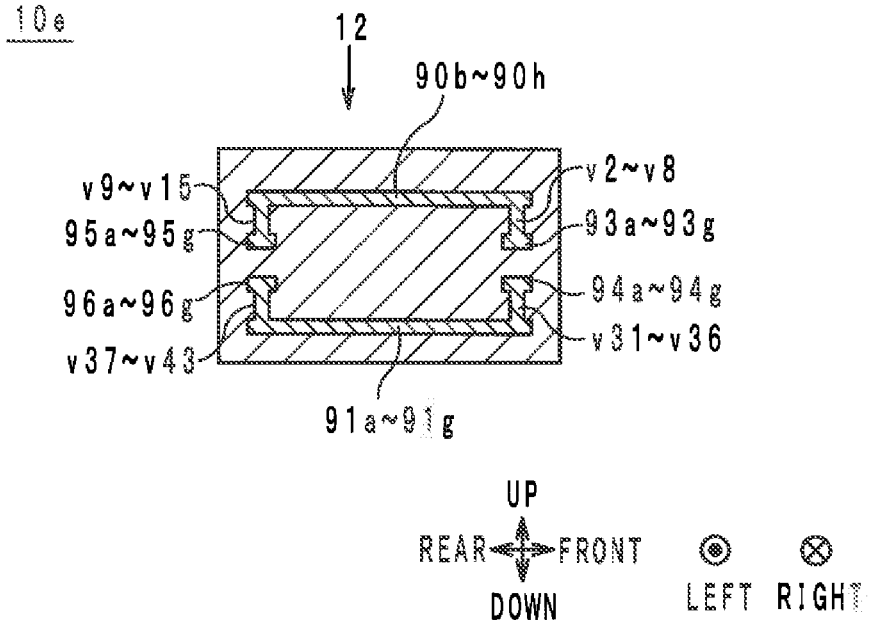
FIG. 15A is a sectional view of the electronic component cut along the line B-B.

An electronic component according to a fifth preferred embodiment of the present invention will hereinafter be described with reference to the drawings. FIG. 12 is a perspective view of the electronic component 10*e* according to the fifth preferred embodiment. FIG. 13A is an exploded perspective view of the electronic component 10*e* according to the fifth preferred embodiment. FIG. 13B is a plan view of linear conductors 90*a*-90*h* and 91*a*-91*g* of the electronic component 10*e*. FIG. 14 is a sectional view of the electronic component 10*e* cut along the line A-A. FIG. 15A is a sectional view of the electronic component 10*e* cut along the line B-B. In the following description, the layer stacking direction of the electronic component 10*e* is referred to as an up-down direction. In a top-down planar view, the direction in which longer sides of the electronic component 10*e* extends is referred to as a right-left direction, and the direction in which shorter sides of the electronic component 10*e* extends is referred to as a front-rear direction.

The electronic component 10*e* includes a multilayer body 12, external electrodes 14*a* and 14*b*, and a coil L. As illustrated in FIGS. 12 and 13A, the multilayer body 12 is a rectangular or substantially rectangular plate in a top-down planar view, and includes dielectric layers (insulating layers) 16*a*-16*e* stacked in this order from the top to the bottom. The dielectric layers 16*a*-16*e* are rectangular or substantially rectangular and are made of a dielectric material, for example, liquid crystal polymer. The dielectric layers 16*a*-16*e* are flexible, and accordingly, the multilayer body 12 is flexible. In the following description, the upper surface of each of the dielectric layers 16*a*-16*e* is referred to as a front surface, and the lower surface of each of the dielectric layers 16*a*-16*e* is referred to as a back surface.

The external electrodes 14*a* and 14*b* are provided on the front surface of the dielectric layer 16*a*, and each of the external electrodes 14*a* and 14*b* has a rectangular or substantially rectangular shape that is long in the front-rear direction. The external electrode 14*a* is arranged along the left shorter side of the dielectric layer 16*a*, and the external electrode 14*b* is arranged along the right shorter side of the dielectric layer 16*a*. Each of the external electrodes 14*a* and 14*b* is formed, for example, by plating a copper foil with Ni and Sn.

The coil L includes linear conductors 90*a*-90*h* and 91*a*-91*g*, connection conductors 93*a*-93*g*, 94*a*-94*g*, 95*a*-95*g* and 96*a*-96*g*, and via-hole conductors v1-v44.

The linear conductors 90*a*-90*h* are provided on the front surface of the dielectric layers 16*b* and are arranged in this order from the left side to the right side with uniform or substantially uniform gaps therebetween. The linear conductors 90*a*-90*h* are made of a copper foil, for example. The linear conductors 90*a*, 90*c*, 90*e* and 90*g* extend in the front-rear direction and have line widths of w11. The linear conductors 90*b*, 90*d*, 90*f* and 90*h* extend in the front-rear direction and have line widths of w12. The width w12 is smaller than the width w11. Accordingly, linear conductors having line widths of w11 (the linear conductors 90*a*, 90*c*, 90*e* and 90*g*) and linear conductors having line widths of w12 (the linear conductors 90*b*, 90*d*, 90*f* and 90*h*) are arranged alternately in the right-left direction (the widthwise direction of the linear conductors). In the following description, the edge in the front of each of the linear conductors 90*a*-90*h* is referred to as a front edge, and the edge in the rear of each of the linear conductors 90*a*-90*h* is referred to as a rear edge.

The linear conductors 91*a*-91*g* are provided on the front surface of the dielectric layers 16*e* and are arranged in this order from the left side to the right side with uniform or substantially uniform gaps therebetween. The linear conductors 91*a*-91*g* are made of a copper foil, for example. The linear conductors 91*a*, 91*c*, 91*e* and 91*g* extend in the front-rear direction and have line widths of w13. The linear conductors 91*b*, 91*d* and 91*f* extend in the front-rear direction and have line widths of w14. The width w14 is smaller than the width w13. Accordingly, linear conductors having line widths of w13 (the linear conductors 91*a*, 91*c*, 91*e* and 91*g*) and linear conductors having line widths of w14 (the linear conductors 91*b*, 91*d* and 91*f*) are arranged alternately in the right-left direction. In the following description, the edge in the front of each of the linear conductors 91*a*-91*g* is referred to as a front edge, and the edge in the rear of each of the linear conductors 91*a*-91*g* is referred to as a rear edge.

The linear conductors 90*a*-90*h* and 91*a*-91*g* are substantially of the same length (the same dimension in the front-rear direction).

As seen in FIGS. 13B and 14, in a top-down planar view, the linear conductors 90*c*, 90*e* and 90*g* overlap the linear conductors 91*b*, 91*d* and 91*f*, respectively. In a top-down planar view, the linear conductors 91*b*, 91*d* and 91*f* do not protrude from the linear conductors 90*c*, 90*e* and 90*g*, respectively, in the widthwise direction.

As seen in FIGS. 13B and 14, in a top-down planar view, the linear conductors 90*b*, 90*d*, 90*f* and 90*h* overlap the linear conductors 91*a*, 91*c*, 91*e* and 91*g*, respectively. In a top-down planar view, the linear conductors 90*b*, 90*d*, 90*f* and 90*h* do not protrude from the linear conductors 91*a*, 91*c*, 91*e* and 91*g*, respectively, in the widthwise direction.

The via-hole conductor v1 pierces through the dielectric layer 16*a* in the up-down direction to connect the external electrode 14*a* to the rear edge of the connection conductor 90*a*. The via-hole conductor v44 pierces through the dielectric layer 16*a* in the up-down direction to connect the external electrode 14*b* to the front edge of the connection conductor 90*h*.

The front edges of the linear conductors 90*a*, 90*c*, 90*e* and 90*g* are electrically connected to the front edges of the linear conductors 91*a*, 91*c*, 91*e* and 91*g*, respectively, which are arranged respectively at the immediate right side (respectively at one side in the widthwise direction) of the linear conductors 90*a*, 90*c*, 90*e* and 90*g* in a top-down planar view. Also, the front edges of the linear conductors 90*b*, 90*d* and 90*f* are electrically connected to the front edges of the linear conductors 91*b*, 91*d* and 91*f*, respectively, which are arranged respectively at the immediate right side (respectively at one side in the widthwise direction) of the linear conductors 90*b*, 90*d* and 90*f* in a top-down planar view.

The rear edges of the linear conductors 90*c*, 90*e* and 90*g* are electrically connected to the rear edges of the linear conductors 91*b*, 91*d* and 91*f*, respectively, which overlap the linear conductors 90*c*, 90*e* and 90*g*, respectively, in a top-down planar view. Also, the rear edges of the linear conductors 90*b*, 90*d*, 90*f* and 90*h* are electrically connected to the rear edges of the linear conductors 91*a*, 91*c*, 91*e* and 91*g*, respectively, which overlap the linear conductors 90*b*, 90*d*, 90*f* and 90*h*, respectively, in a top-down planar view. A detailed description will be given below.

The connection conductors 93*a*-93*g* are provided on the front surface of the dielectric layer 16*c*, and are rectangular or substantially rectangular. The connection conductors 93*a*-93*g* are arranged in this order from the left side to the right side along the front longer side of the dielectric layer 16*c*. In a top-down plan view, the left edges of the connection conductors 93*a*-93*g* overlap the front edges of the linear conductors 90*a*-90*g*, respectively.

The connection conductors 94*a*-94*g* are provided on the front surface of the dielectric layer 16*d*, and are rectangular or substantially rectangular. The connection conductors 94*a*-94*g* are arranged in this order from the left side to the right side along the front longer side of the dielectric layer 16*d*. In a top-down planar view, the left edges of the connection conductors 94*a*-94*g* overlap the right edges of the connection conductors 93*a*-93*g*, respectively. Also, in a top-down plan view, the right edges of the connection conductors 94*a*-94*g* overlap the front edges of the linear conductors 91*a*-91*g*, respectively.

The via-hole conductors v2-v8 pierce through the dielectric layer 16*b* in the up-down direction to connect the front edges of the linear conductors 90*a*-90*g* to the left edges of the connection conductors 93*a*-93*g*, respectively. The via-hole conductors v16-v22 pierce through the dielectric layer 16*c* in the up-down direction to connect the right edges of the connection conductors 93*a*-93*g* to the left edges of the connection conductors 94*a*-94*g*, respectively. The via-hole conductors v30-v36 pierce through the dielectric layer 16*d* in the up-down direction to connect the right edges of the connection conductors 94*a*-94*g* to the front edges of the linear conductors 91*a*-91*g*, respectively. Thus, as seen in FIGS. 13A-15A, the via-hole conductors v2-v8, v16-v22 and v30-v36 are not connected straight in the up-down direction.

The connection conductors 95*a*-95*g* are provided on the front surface of the dielectric layer 16*c*, and are rectangular or substantially rectangular. The connection conductors 95*a*-95*g* are arranged in this order from the left side to the right side along the rear longer side of the dielectric layer 16*c*. In a top-down plan view, the left edges of the connection conductors 95*a*-95*g* overlap the rear edges of the linear conductors 90*b*-90*h*, respectively.

The connection conductors 96*a*-96*g* are provided on the front surface of the dielectric layer 16*d*, and are rectangular or substantially rectangular. The connection conductors 96*a*-96*g* are arranged in this order from the left side to the right side along the rear longer side of the dielectric layer 16*d*. In a top-down plan view, the connection conductors 96*a*-96*g* overlap the connection conductors 95*a*-95*g*. Also, in a top-down plan view, the left edges of the connection conductors 96*a*-96*g* overlap the rear edges of the linear conductors 91*a*-91*g*, respectively.

The via-hole conductors v9-v15 pierce through the dielectric layer 16*b* in the up-down direction to connect the rear edges of the linear conductors 90*b*-90*h* to the left edges of the connection conductors 95*a*-95*g*, respectively. The via-hole conductors v23-v29 pierce through the dielectric layer 16*c* in the up-down direction to connect the right edges of the connection conductors 95*a*-95*g* to the right edges of the connection conductors 96*a*-96*g*, respectively. The via-hole conductors v37-v43 pierce through the dielectric layer 16*d* in the up-down direction to connect the left edges of the connection conductors 96*a*-96*g* to the rear edges of the linear conductors 91*a*-91*g*, respectively. Thus, as seen in FIGS. 13A-15A, the via-hole conductors v9-v15, v23-v29 and v37-v43 are not connected straight in the up-down direction.

The coil L having the structure above has a spiral shape spiraling clockwise from the left side to the right side.

The electronic component 10*e* having the structure above has the same effects as the electronic component 10*a*.

Additionally, in the electronic component 10*e*, the risk of breakage of the via-hole conductors v2-v43 is significantly reduced or eliminated. This will hereinafter be described with the connection conductors 93*a*, 94*a* and the via-hole conductors v2, v16 and v30 taken as an example.

At a step of pressure-bonding the multilayer body, the dielectric layers and the via-hole conductors are heated. In this regard, the amounts of expansion and contraction of the via-hole conductors, which are made of a conductive material, with changes in temperature are greater than the amounts of expansion and contraction of the dielectric layers, which are made of thermoplastic resin, with changes in temperature. Accordingly, at the pressure-bonding step, the amount of expansion in the up-down direction of each via-hole conductor is greater than the amount of expansion in the up-down direction of each dielectric layer. Consequently, in the pressure-bonding step, forces are applied concentrically to each via-hole conductor from above and from underneath. Under the circumstances, if the via-hole conductors are connected straight in the up-down direction, there is a risk of breakage of the via-hole conductors due to the forces applied from above and underneath.

In the electronic component 10*e*, the via-hole conductor v2 and the via-hole conductor v16 are not connected straight. Specifically, in a top-down planar view, the lower end of the via-hole conductor v2 that contacts with the connection conductor 93*a* from above does not overlap the upper end of the via-hole conductor v16 that contacts with the connection conductor 93*a* from underneath. Therefore, even if a force is applied to the via-hole conductor v2 from above at the pressure-bonding step, the force is not directly transmitted from the via-hole conductor v2 to the via-hole conductor v16. Likewise, even if a force is applied to the via-hole conductor v16 from underneath at the pressure-bonding step, the force is not directly transmitted from the via-hole conductor v16 to the via-hole conductor v2. Thus, applications of great forces to the via-hole conductors v2 and v16 from above and from underneath are prevented. Consequently, the risk of breakage of the via-hole conductors v2 and v16 is significantly reduced or eliminated.

The via-hole conductor v16 and the via-hole conductor v30 are not connected straight. Specifically, in a top-down planar view, the lower end of the via-hole conductor v16 that contacts with the connection conductor 94*a* from above does not overlap the upper end of the via-hole conductor v30 that contacts with the connection conductor 94*a* from underneath. Therefore, even if a force is applied to the via-hole conductor v16 from above at the pressure-bonding step, the force is not directly transmitted from the via-hole conductor v16 to the via-hole conductor v30. Likewise, even if a force is applied to the via-hole conductor v30 from underneath at the pressure-bonding step, the force is not directly transmitted from the via-hole conductor v30 to the via-hole conductor v16. Thus, applications of great forces to the via-hole conductors v16 and v30 from above and from underneath are prevented. Consequently, the risk of breakage of the via-hole conductors v16 and v30 is significantly reduced or eliminated.

The linear conductors 90*a*-90*h* and the linear conductors 91*a*-91*g* extend in the same direction. Therefore, in the coil L, the direction of magnetic field generated by the linear conductors 90*a*-90*h* and the direction of magnetic field generated by the linear conductors 91-91*g* are the same. This results in a large inductance value of the coil L and an improved Q value of the coil L.

In the electronic component 10*e*, further, the risk of delamination of the multilayer body 12 is reduced. A detailed description will be hereinafter given with the via-hole conductors v2, v16 and v30 taken as an example.

In the electronic component 10*e*, in a top-down planar view, the lower end of the via-hole conductor v2 that contacts with the connection conductor 93*a* from above does not overlap the upper end of the via-hole conductor v16 that contacts with the connection conductor 93*a* from underneath. Likewise, in a top-down planar view, the lower end of the via-hole conductor v16 that contacts with the connection conductor 94*a* from above does not overlap the upper end of the via-hole conductor v30 that contacts with the connection conductor 94*a* from underneath. Accordingly, the via-hole conductors v2, v16 and v30 are not connected straight. Therefore, at the pressure-bonding step, there is almost no risk that expansion of the via-hole conductors v2, v16 and v30 by heat causes the via-hole conductors v2, v16 and v30 to protrude significantly from the dielectric layers 16*b*-16*d*. Consequently, the risk of delamination between the dielectric layers 16*a* and 16*b* around the via-hole conductor v2 and the risk of delamination between the dielectric layers 16*d* and 16*e* around the via-hole conductor v30 can be reduced. Thus, the risk of delamination of the multilayer body 12 is significantly reduced or eliminated.

Since there is almost no risk of significant protrusions of the via-hole conductors v2, v16 and v30 from the dielectric layers 16*b*-16*d*, there is almost no risk that the via-hole conductors v2 and v30 pierce and break the linear conductors 90*a* and 91*a*, respectively. Accordingly, in the electronic component 10*e*, the risk of breakages of the linear conductors 90*a*-90*h* and 91-91*g* is significantly reduced or eliminated.

Also, the multilayer body 12 of the electronic component 10*e* is easy to bend. A detailed description will hereinafter be given with the connection conductors 93*a*, 94*a* and the via-hole conductors v2, v16 and v30 as an example.

In the electronic component 10*e*, the via-hole conductors v2, v16 and v30 are not connected straight. Specifically, the connection conductor 93*a* is provided between the via-hole conductor v2 and the via-hole conductor v16, and the connection conductor 94*a* is provided between the via-hole conductor v16 and the via-hole conductor v30. The bedded connection conductors 93*a* and 94*a* are easy to bend as compared to the rod-like via-hole conductors v2, v16 and v30. Therefore, when the multilayer body 12 is bent, the connection conductors 93*a* and 94*a* bend, and the via-hole conductors v2, v16 and v30 hardly bend. Accordingly, it is possible to bend the multilayer body 12 easily without breaking the via-hole conductors v2, v16 and v30, and the dielectric layers 16*a*-16*e*.

In the electronic component 10*e*, the coil L has a great inductance value. A detailed description will hereinafter be given with the connection conductors 93*a*, 94*a* and the via-hole conductors v2, v16 and v30 taken as an example.

The connection conductors 93*a*, 94*a* and the via-hole conductors v2, v16 and v30 define a stair-shaped configuration. Therefore, the direction of electric current flowing along the connection conductor 93*a* and the direction of electric current flowing along the connection conductor 94*a* are the same. Accordingly, the direction of magnetic field generated around the connection conductor 93*a* and the direction of magnetic field generated around the connection conductor 94*a* are the same. Thus, these magnetic fields do not cancel each other. Consequently, in the electronic component 10*e*, the coil L has a great inductance value.

Sixth Preferred Embodiment

Figure 15B:
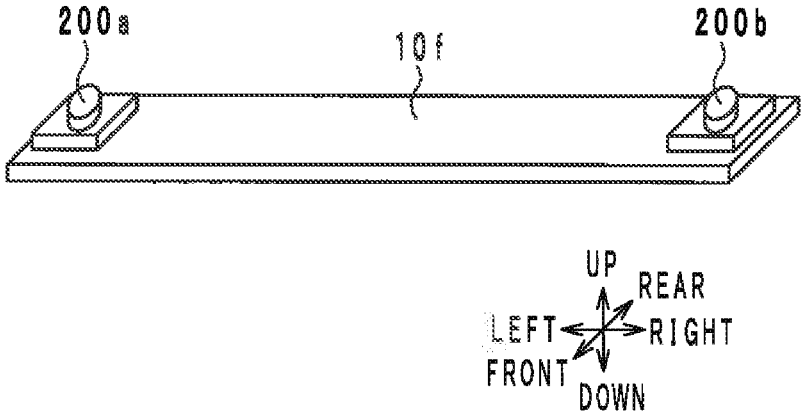
FIG. 15B is a perspective view of an electronic component according to a sixth preferred embodiment of the present invention.
Figure 16:
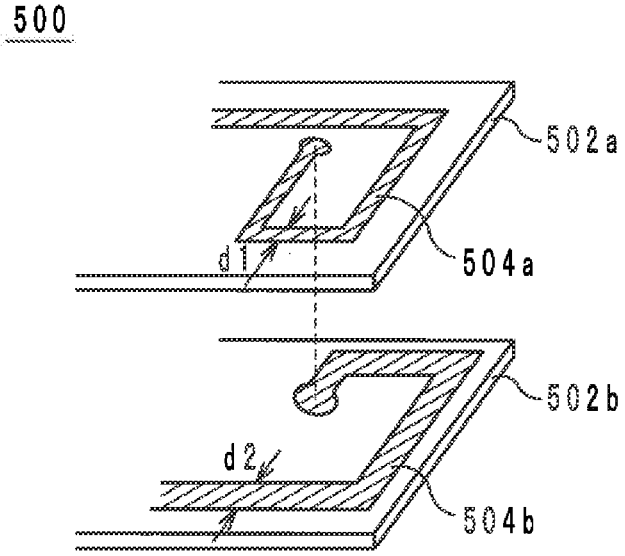
FIG. 16 PRIOR ART
FIG. 16 is an exploded perspective view of a high-frequency coil disclosed in Japanese Patent Laid-Open Publication No. H05-36532.
Figure 17:
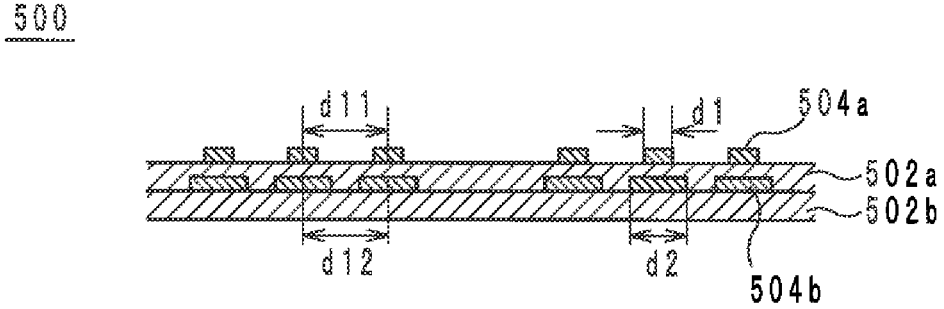
FIG. 17 PRIOR ART
FIG. 17 is a sectional view of a high-frequency coil using spiral coil patterns.

An electronic component 10*f* according to a sixth preferred embodiment of the present invention will hereinafter be described with reference to the drawings. FIG. 15B is a perspective view of the electronic component 10*f* according to the sixth preferred embodiment.

The electronic component 10*f* is a high-frequency signal line. At the right end and the left end of the electronic component 10*f*, external electrodes (not illustrated in FIG. 15B) are provided respectively. On the external electrodes, connectors 200*a* and 200*b* are provided, respectively. The internal structure of the electronic component 10*f* is substantially the same as the internal structure of either one of the electronic components 10*a*-10*e*, and a detailed description thereof is omitted.

The electronic component 10*f* has the same effects as the electronic components 10*a*-10*e*.

Other Preferred Embodiments

Electronic components according to the present invention are not limited to the electronic components 10*a*-10*f*, and various changes and modifications are possible within the scope of the present invention.

The structures of the electronic components 10*a*-10*f* may be combined with one another, for example.

In each of the electronic components 10*a*-10*f*, the multilayer body 12 includes dielectric layers stacked on one another. However, the multilayer body 12 may include magnetic layers stacked on one another.

In the electronic component 10*c*, the coil conductor 50 and the coil conductor 52 spiral in the same direction. However, the coil conductor 50 and the coil conductor 52 may spiral in opposite directions.

In the respective processes of producing the electronic components 10*a*-10*f*, a sequential stacking and pressure-bonding method in which dielectric sheets are stacked on one another and subsequently are pressure-bonded together is adopted. However, for example, a printing method in which printing of an insulating layer and printing of a conductive layer are repeated may be adopted. In a case in which ceramic green sheets are used as the dielectric sheets, a sintering step may be carried out after the pressure-bonding step.

The multilayer body 12 does not need to be flexible.

Figure 18:
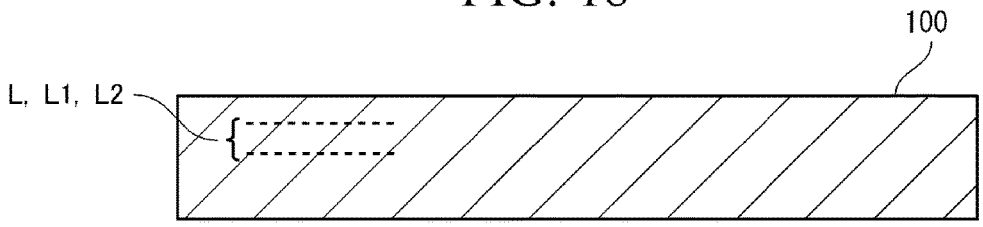
FIG. 18 is a sectional view of an electronic component according to a preferred embodiment of the present invention.

The electronic components 10*a*-10*f* preferably are chip components to be mounted on circuit boards or the like. However, each of the electronic components 10*a*-10*f* may be produced as a portion of a circuit board. Specifically, as shown in a sectional view in FIG. 18, the coil L or the coils L1 and L2 of each of the electronic components 10*a*-10*f* may be incorporated in a circuit board 100. In this case, the circuit board is regarded as an electronic component.

In the electronic component 10*a*, the linear conductive portions 22*a* and 22*c* having relatively great line widths and the linear conductive portion 22*b* having a relatively small line width do not need to be provided on the same dielectric layer. Likewise, the linear conductive portions 26*a* and 26*c* having relatively great line widths and the linear conductive portion 26*b* having a relatively small line width do not need to be provided on the same dielectric layer. However, it is the minimum necessary that the linear conductive portions 26*a*-26*c* are provided on one or more dielectric layers arranged lower than the one or more dielectric layers on which the linear conductive portions 22*a*-22*c* are provided. This also applies to the electronic components 10*b*-10*f*.

As thus far described, various preferred embodiments of the present invention are applicable to electronic components, and are useful especially in downsizing electronic components.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An electronic component comprising:

a multilayer body including a plurality of insulating layers stacked on one another in a stacking direction;

a first linear conductor provided on one of the insulating layers and having a first line width;

a second linear conductor provided on one of the insulating layers and having a second line width smaller than the first line width;

a third linear conductor provided on one of the insulating layers that is arranged at one side in the stacking direction of the insulating layer on which the first linear conductor is provided and the insulating layer on which the second linear conductor are provided, and having a third line width; and a fourth linear conductor provided on one of the insulating layers that is arranged at one side in the stacking direction of the insulating layer on which the first linear conductor is provided and the insulating layer on which the second linear conductor are provided, and having a fourth line width smaller than the first line width and smaller than the third line width; wherein the first linear conductor and the second linear conductor are arranged in a widthwise direction of the first and the second linear conductors;

the third linear conductor and the fourth linear conductor are arranged in a widthwise direction of the third and the fourth linear conductors;

the first linear conductor and the fourth linear conductor overlap each other in a planar view from the stacking direction such that an entire formation region of the fourth linear conductor is included in a formation region of the first linear conductor;

the second linear conductor and the third linear conductor overlap each other in a planar view from the stacking direction such that an entire formation region of the second linear conductor is included in a formation region of the third linear conductor; and the first, the second, the third and the fourth linear conductors are electrically connected to define a coil.

2. The electronic component according to claim 1, wherein the first linear conductor and the second linear conductor are connected in series to define a first spiral coil conductor;

the third linear conductor and the fourth linear conductor are connected in series to define a second spiral coil conductor; and the first spiral coil conductor and the second spiral coil conductor are connected to each other.

3. The electronic component according to claim 2, wherein at least one of the first linear conductor, the second linear conductor, the third linear conductor and the fourth linear conductor has a length substantially corresponding to one turn of the first spiral coil conductor or the second spiral coil conductor.

4. The electronic component according to claim 1, wherein:

the first, the second, the third and the fourth linear conductors extend in a predetermined direction;

one end in the predetermined direction of each of the first, the second, the third and the fourth linear conductors is defined as a first end and another end in the predetermined direction of each of the first, the second, the third and the fourth linear conductors is defined as a second end;

the first end of the first linear conductor is electrically connected to the first end of the third linear conductor arranged at one side in the widthwise direction of the first linear conductor to be adjacent to the first linear conductor in a planar view from the stacking direction;

the second end of the first linear conductor is electrically connected to the second end of the fourth linear conductor arranged to overlap the first linear conductor in a planar view from the stacking direction;

the first end of the second linear conductor is electrically connected to the first end of the fourth linear conductor arranged at one side in the widthwise direction of the second linear conductor to be adjacent to the second linear conductor in a planar view from the stacking direction; and the second end of the second linear conductor is electrically connected to the second end of the third linear conductor arranged to overlap the second linear conductor in a planar view from the stacking direction.

5. The electronic component according to claim 4, wherein the first end of the first linear conductor and the first end of the third linear conductor are connected to each other through a plurality of via-hole conductors piercing through the plurality of insulating layers respectively; and the plurality of via-hole conductors are not arranged straight in a planar view from a direction perpendicular or substantially perpendicular to the stacking direction.

6. The electronic component according to claim 1, wherein the first linear conductor and the second linear conductor are provided on one of the insulating layers; and the third linear conductor and the fourth linear conductor are provided on another of the insulating layers.

7. The electronic component according to claim 1, wherein the multilayer body is flexible.

8. The electronic component according to claim 1, wherein the insulating layers are made of liquid crystal polymer.

9. The electronic component according to claim 1, wherein each of the plurality of insulating layers is one of a dielectric layer and a magnetic layer.

10. The electronic component according to claim 1, wherein the electronic component is one of a chip component and a portion of a circuit board.

* * * * *